US006158604A

United States Patent [19]

Larguia, Sr. et al.

[11] Patent Number: 6,158,604

[45] **Date of Patent: *Dec. 12, 2000**

[54] CONTAINER SAFETY CAP WITH SAFETY SEAL AND COMBINATION OF SUCH A CAP WITH A CONTAINER

[75] Inventors: Constancio Larguia, Sr., Cerrito 1070, Buenos Aires 1010; Constancio Larguia, Jr., Buenos Aires, both of Argentina

[73] Assignee: Constancio Larguia, Sr., Buenos Aires, Argentina

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/956,023

[22] Filed: Oct. 22, 1997

Related U.S. Application Data

[63] Continuation-in-part of application No. 08/749,690, Nov. 15, 1996, Pat. No. 5,960,972.

[51] Int. Cl.[7] ..... B65D 55/02

[52] U.S. Cl. ..... 215/217; 215/218; 215/230; 215/274; 215/277; 215/250; 215/253; 215/307; 215/341; 220/256; 220/319

[58] Field of Search ..... 215/201, 204, 215/224, 230, 253, 250, 277, 272, 274, 279, 307, 317, 322, 341, 346, 349, 216–220; 206/459.1; 220/255, 256, 257, 265, 266, 319

[56] References Cited

U.S. PATENT DOCUMENTS

| | | | |
|---|---|---|---|
| 1,862,620 | 6/1932 | Graham | 215/274 |
| 2,045,480 | 6/1936 | Magnesen et al. | 215/274 X |
| 2,772,803 | 12/1956 | Pasquariello | 215/219 |
| 3,013,687 | 12/1961 | Gould | 215/249 X |
| 3,156,369 | 11/1964 | Bowes et al. . | |
| 3,193,128 | 7/1965 | Ravn | 215/250 |
| 3,401,819 | 9/1968 | Salamone | 220/266 X |
| 3,878,961 | 4/1975 | Curry et al. | 215/219 |
| 4,279,353 | 7/1981 | Honma . | |
| 4,480,759 | 11/1984 | Behrens et al. | 215/220 |
| 4,555,036 | 11/1985 | Bekkers et al. . | |
| 4,632,264 | 12/1986 | Evans | 215/220 |
| 4,669,620 | 6/1987 | Coifman | 215/220 |
| 4,673,095 | 6/1987 | Puresevic et al. | 215/220 |
| 4,729,487 | 3/1988 | Wright | 215/220 X |
| 4,747,497 | 5/1988 | Holman | 215/230 |
| 5,148,931 | 9/1992 | Minh . | |
| 5,209,362 | 5/1993 | Lutzker | 215/274 X |
| 5,314,084 | 5/1994 | Folta et al. . | |
| 5,316,163 | 5/1994 | Von Schuckmann . | |
| 5,615,788 | 4/1997 | Larguia | 215/274 |
| 5,676,268 | 10/1997 | King | 215/218 X |
| 5,762,215 | 6/1998 | Ogden | 215/220 |
| 5,960,972 | 10/1999 | Larguia, Sr. | 215/274 |

*Primary Examiner*—Allan N. Shoap
*Assistant Examiner*—Robin A. Hylton
*Attorney, Agent, or Firm*—Evenson, McKeown, Edwards & Lenahan, P.L.L.C.

[57] ABSTRACT

One form of a cap for a container includes an internal part and an external part relatively movable with respect to one another among closed, intermediate and open cap positions. Complementary structures protrude from the internal and external parts for dictating relative positions of the internal and external parts as the parts are initially joined together. Interengaging elements on the internal and external parts secure a selected portion of one of the internal and external parts to the other after joining the parts together. A breakable seal between the selected portion of the one of the internal and external parts and the remainder of the one of the internal and external parts, when broken, allows the internal and external parts to move relative to one another. Variations are also disclosed.

17 Claims, 21 Drawing Sheets

CONTAINER SAFETY CAP WITH SAFETY SEAL AND COMBINATION OF SUCH A CAP WITH A CONTAINER

CROSS-REFERENCE TO RELATED APPLICATIONS

This application is a continuation-in-part of U.S. patent application Ser. No. 08/749,690, filed Nov. 15, 1996, now U.S. Pat. No. 5,960,972 and is related to the subject matter of U.S. patent application Ser. No. 08/513,508, filed Aug. 10, 1995, now U.S. Pat. No. 5,615,788. The disclosures of the prior application and the prior patent are incorporated herein by reference.

BACKGROUND OF THE INVENTION

1. Field of the Invention

The present invention relates to multiple improvements to a safety closure or cap for sealing a bottle or other container in which liquid, granular material, particulate material or any other material including solids is contained. The invention also relates to the combination of a container sealed by a closure or cap having such improvements. The improvements permit the closure to perform in a more efficacious way than prior closures.

2. Description of Related Art

In the prior combinations of a cap and a container, the cap is provided with an internal structure and an external structure. These structures are movable with respect to one another among closed, intermediate and open cap positions. A plurality of hooks is provided on the internal structure for grasping a bead on the container when the cap is in the closed and intermediate cap positions. Ribs, disposed on the external structure, include upper extremities which prevent the cap from being placed directly from the closed cap position into the open cap position. Pressure relief of the container, if any, occurs in the intermediate position. The external structure of the cap defines a safety seal for indicating that the cap has been moved from the closed position.

SUMMARY OF THE INVENTION

It is a primary object of this invention to provide improvements to the design of the previously described closures. These improvements add certain qualities to the nature of such a cap that will better result in the already achieved benefits and introduce new benefits so as to produce a more attractive closure in compliance with industry standards. The invention also attends to molding operations for manufacturing the cap, the stability of the closure from a production plant through a bottling plant and until the consumer acquires the main product, and the consumer's performance in handling the cap.

Various designs address nineteen different utilities that might improve the functionality of the closure. The new structures serve, in a more efficacious and efficient manner, to 1) improve the process of assembling both parts of the closure during the production process; 2) eliminate the hole previously defined in the roof of the external part to facilitate the production process and to add marketing appeal to the product; 3) redefine the disposition of the upstanding flanges of the internal part and their complementary structure in the external part, as alternated units, to facilitate the molding process; and 4) introduce a groove, in a perimetrical disposition, in the internal part so to improve flexing capabilities of the internal part.

The structures also serve to 5) include a mold oriented design for the channels of the internal part to diminish complexity in the needed production machinery; 6) propose a new gripping disposition for the skirt defined in the internal part that might facilitate the consumer's handling of the cap; 7) provide a structure to secure a mounted position of both parts of the closure in a stable status to minimize the risk of undesired closing of the closure before the bottling operation; 8) provide a method that reinforces the closed position of the cap to better resist hazardous treatment; 9) present an improved design for the disposition of the connectors between areas of the external part to be detached along the breach line when rotation of such an external part is made; and 10) present the design for a complete rib, present in the external part, that would add to the system the requirement for an unequivocally conducted twist operation to release the closure, voiding possibility of aleatory twisting.

The structures additionally serve to 11) present the design for an intermediate rib in the external part, not connected at its extremes to a top or inferior roof or flange, that would allow the consumer to perform opening and re-closing operations in a different manner than with a complete rib; such expands marketing possibilities by allowing a focus on different types of consumer preferences.

Moreover, the structures 12) present the possibility of closing and re-closing the closure with a snap-on operation of the cap over the extreme of the container in a way that assures hermetic standards; 13) provide a cooperation of structures that will grant to the consumer the capability of regulating and controlling the intensity of venting activity during the opening process with the intention of avoiding splashing of the liquid from inside the container when such a container has been shaken or for any other reason that would make this happen; 14) present a design for a structure that, composed of complementary patterns to be joined, guides other complementary structures of both parts to an effective joining action during the bottling process and secures the circular center area of the external part to the roof of the internal part in a way that avoids any possibility of rotation or horizontal displacement of such circular center area during a twisting operation of the external part; this assures a proper breach of the circular boundary line, defined as a breach line, to evidence tampering.

Additionally, the structures 15) optimize the venting process of releasing pressure contained in the bottle whenever such pressure is present; and 16) mathematically define a pattern for the disposition of complementary structures of both parts of the closure in a way that unequivocal interaction of such structures will be reached during handling of the cap by the consumer. Finally, the structures 17) present the existence of an equalizer effect to control the tolerances in the variation of the shape of the extreme of returnable type glass bottles so as to assure an hermetic performance of this plastic crown over such bottles; 18) present the alternative of an internal part of the closure that will minimize the height of the whole system and diminish the requirements of raw material for each closure; and 19) present an alternative tamper evidence device which provides resistance to rude treatment, avoids residual impact on the rest of the system after releasing the closure for the first time, and avoids the possibility of neutralizing the evidence of tampering by a voluntary action. All designs concern the capability of the closure to be molded or produced.

The above objects are accomplished with a closure for a container which is made of an internal structure and an external structure which cooperate to effect the above described qualities in a unique way.

The process of assembling both parts of the closure is improved in such a way that the structure to be described allows the parts to be joined, during the production stage of the cap, by a snap action. In a mounted position status, the closure is ready to be plugged over the neck of the bottle.

The suppression of the hole in the center of the previously mentioned external part of the closure minimizes complexity in the needed mold to produce the cap according to state of the art machinery, and adds attractiveness to the closure, from a marketing aspect, by defining an external surface that is continual and smooth. This is possible now because the cap can be compressed not only by rotation but by a snap operation too.

The alternated disposition for the upstanding flanges belonging to the internal structure addresses a concern associated with molding which requires that, once the "core" of the molding machine defines the shape of the structure around itself, it is necessary to rotate the core through the needed degrees to be freed from the undercut or structure that has recently been created when such "core" was in the immediate previous position. The circular in-line design of the upstanding flanges has to satisfy the need for a sufficiently large space between each flange to allow the core used for its creation to escape from the cavity of the mold without spoiling or damaging the recently created flange.

By introducing a groove in a perimetrical disposition in the internal part, flexing capabilities of the skirt defined in such an internal part are improved. By diminishing the thickness of the transition area from the main plate of the internal part to the skirt vertically disposed from it, the portions which form the lifting ring can flex radially downwardly to allow the external part to easily pass over the mentioned lifting ring in the assembling operation. Another benefit of the existence of the flexing capabilities induced by this perimetrical groove is obtained by the combination of this quality and another quality by which individual segments of the skirt can grip the bottle in such a way that an arching effect will be translated over the main plate of the internal part and thus enhance the capabilities of hermetically sealing the bottle. The arching effect is reached because the length of the skirt is a little bit shorter that the length that would be assigned to such a skirt if the extremes of the skirt fit perfectly in a groove of the bottle. When the length of the skirt is short, the skirt does not perfectly fit on the groove, but remains laying over the slope of the extreme of the bottle that leads to the groove. When the binding ring is downwardly projected as a result of a closing action of the system, the extremes of the skirt will fit in the groove, making a tension force in the horizontal plane of the closure. Consequently, an arch effect results.

A mold oriented design for the channels of the internal part will facilitate the design of the production machinery for this cap by diminishing complexity of the required tools and, subsequently, the cost of manufacturing such machinery. The channels are provided with a trapezoidal configuration which will perfectly accomplish the path function for which they were conceived and which is easily molded. Previous designs consisted of an oblique or inclined configuration channel which provided guidance with a right side and conducted the complementary rib of the external part in an upwardly twisting movement. The left side of the channel had no reason to be inclined with a disposition parallel to the right side, since such an oblique configuration did not attend to any needed specification. According to production techniques of the molding industry, with parallel sides of the channel design, a tool that could create this undercut and be freed of the structure surrounding it without spoiling what it had recently created might be difficult to make. A trapezoidal configuration will still satisfy the needed oblique path on the right side of the channel and allow the tool of the machinery to efficiently operate.

Another novelty is a new gripping disposition for the skirt, vertically disposed from the main plate of the internal part, that might facilitate the consumer's handling of the cap during de-capping and re-capping operations. The nature of this modification is to make the segments, forming part of the mentioned skirt, project radially, outwardly and downwardly as they grow distant from the main plate. This will not prejudice hermetic capabilities of the closure and will cooperate to enhance hermetic aspects, together with the above-mentioned principle of arch effect. The outward design of the skirt will facilitate the gripping action of the internal part when mounting the closure over the neck of the bottle and will enhance the arch effect desired to improve the hermetic aspect when segments of the skirt receive binding pressure. Moreover, during the process of releasing the closure, the potential expanding strength of the bonded segments to outwardly recover their original disposition once pressed by the flange of the external part, which acts as a binding ring, joined with the arch effect of the perimetrical groove, will, in a first stage, impulse, in cooperation with the twisting action performed by the consumer, the external part of the closure to axially and upwardly project itself as part of the opening operation towards the so-called intermediate position for venting purposes. In second stage, once the venting operation is performed, a twist and pull action of the external part follows to make the clamping surface extremes of the segments that configure the skirt release the groove of the neck of the bottle. This releasing action will be facilitated due to the original radially, outwardly, downwardly disposition of the skirt now re-acquired in the opening process.

In the mounted position, the telescopically projected closure is not able to close or axially compress itself by mistake before the bottling process, in which case the closure would be disabled or rendered useless. This objective is reached by synchronized interlocking disposition of two complementary structures created for this purpose. Once both parts have been created and need to be coupled to become a functional system, by positioning the external part over the internal part and snapping it on, the closure will become interlocked and ready to be applied by the bottling machinery over the container. Thus, the complete closed position is reached and the capabilities that define this system as a secure closure are achieved. This coupled, but not closed, status prepares the system to be efficiently applied by the corresponding machinery. The possibility of undesired closing of the closure before the convenient instance for bottling process is avoided. Undesired closing of the system before the bottling process would render the closure useless. This structure minimizes the probability of spoiling the closure during shipment from the production plant to the bottling plant. The parts can also be shipped from the production plant in an independent way (not joined yet), and be assembled in the bottling plant as a part of the bottling operation. If parts are shipped separately, there is no risk of ruined caps due to activated hooking situations between the parts, and the carriage itself is simplified and, hence, less costly. The cost of assembling both parts will be present anyway regardless of whether the operation is held in the production plant or in the bottling plant. If the assembling process is done in the bottling plant, the risk of ruined caps during the shipment is avoided.

The closed position, before closure is released by the consumer, has been reinforced so to effectively resist rude or hazardous treatment during the chain of processes from the bottling plant until the moment when the consumer releases the closure. The probabilities of ruining or spoiling the tamper evidence device of this closure due to poor treatment during distribution are diminished by the present structure. The result of this poor treatment previously would have been the ruin of the breach line, providing proof and evidence of a tampered status of the closure for reasons different from the consumer's voluntary releasing action. Due to the nature of the tamper evidence observed in this system, the difference of levels between external and internal parts along the external annular area of the cap could have been manifested as result of a voluntary opening performance of the closure by the consumer or as a result of a non-voluntary event like an external hit or scratch over the annular area of the external part, which was solely maintained by the breach line. It became necessary to provide the system with an internal support for this external annular area which supplements and reinforces the existing breach line. Now, no hit, scratch or poor treatment over this annular ring will make the breach line break and make part of the external annular area move down to lie over the annular area of the main plate of the internal part due to the difference in levels. An extension of the rib belonging to the external part is now the object of this needed support for the critical external annular area. The rib will be interlocked with a structure of the internal part in a way such that only a voluntary twisting action from the consumer will make the breach line break. Thus, by relating the breach line to the external annular area and supporting this external annular area by a rib, which is supported by a flange of the internal part, any hit over the external part will ultimately be supported by the internal part. Hence, only a voluntary and proper twist and pull force applied to the interaction of both parts will make the breach line break. No action different from this will make the breach line break.

A design for optimal performance of the breach line and providing tamper evidence quality is presented. The breach action will be efficiently observed due to a special disposition of the elements forming segments along the boundary to be broken. This special disposition consists of a radially oblique pattern of such elements which is to be aligned, for example, in the mentioned inclined segments that join the parts to be detached. These segments are the objects to be stretched until broken, by elongation, to disjoin these parts during the rotational force producing the opening movement. The tamper evidence quality to be observed is activated in conjunction with this feature and others.

Another object of these improvements is the inclusion of a design for a complete rib, belonging to the external part, that will add to the system the quality of an unequivocally conducted twist operation to release the closure. This minimizes aleatory or unnecessary twisting action. Positioned over the corresponding channel, these complete ribs will provide the system with a predetermined sequential operation that will improve a consumer decapping operation. The complete rib minimizes the probabilities of wrongful usage or mistaken operations from the consumer. Only voluntary and proper interaction of both parts will induce the breach line to break. Not even the consumer will be able to perform wrongful movements of the parts that may lead to undesired situations. Any voluntary act of the consumer will definitely lead to a proper use of the system. The closure will not be released in any other way than the expected one. This complete rib structure reduces the probability of breakage of the breach line by aleatory circumstances in the different stages occurring during shipping from the bottling plant to the place where the product is to be sold. Any stroke or hit that the external surface of the closure may receive during these processes will not cause the breach line to break. The integrity of the system is assured until the consumer decides to tamper with the cap.

Another specification related to the analysis of ribs will now be added. It is now intended to focus on the relation between the ribs and the venting process, and the relation between the ribs and the re-capping process. In this analysis, the ribs are in an intermediate disposition regarding the internal wall over which they have been conceived. Specifically, the superior top of the ribs does not reach the top horizontal plate of the external part. The inferior extreme of such ribs does not reach the binding flange of the external part. Both extremes of the ribs have functions complementing the opening and re-capping processes. The first function is related to the venting capabilities of the system and will be held during the opening process. While the external part is being elevated, the top extreme of the ribs push the flange present in the internal part upwardly. The flange is a frame for channels through which the ribs might be conducted. This pushing action, which impacts entirely in the internal part, will make the internal liner present in the ceiling of the internal part loosen or relax the pressure applied over the mouth of the container for hermetic purposes. Thus, the venting process takes place in a secure way, considering that the segments belonging to the internal skirt are not yet able to completely flex and release the neck of the bottle. A dangerous pop-off of the closure is avoided.

After the venting process is effectively made, a short counterclockwise twist, searching for the correspondent channel, will make the ribs continue their path to a complete opening status of the system. The venting process is perfectly controlled by the consumer to handle the positive pressure present in the container for security reasons. The consumer is unable to release the closure quickly and possibly cause the cap to pop off due to internal carbonated or positive pressure. The consumer is in charge of what he or she should be in charge of, but is not able to perform malicious or dangerous operations like voluntarily making the cap pop off. There is no possibility that, by chance or not, a continuous fast movement would make the cap to pop-off. The second object of this intermediate rib concerns its inferior extreme. After the venting process, the cap is completely projected upwardly to be released, and is finally released. If the consumer then desires to re-cap the closure to store unfinished beverage inside of the container, then the following operation might be implemented. The system would be in a state in which the ribs have completely passed through their corresponding channels in such a way that the external part can continue twisting over the internal part. Inferior extremes of the ribs are positioned over the outwardly disposed flange of the internal part, in which channels are defined. In this state, segments belonging to the internal skirt would be able to flex to grip the neck of the bottle if a snap-on force is applied over the external part. Pushing the external part towards the neck of the bottle allows intermediate ribs to put pressure over the flange and onto the internal part, which is axially downwardly projected. The internal part is able to grip the neck of the bottle. After this gripping action secures the internal part on the bottle, a clockwise twist of the external part searching for the channels to conduct the corresponding ribs, causes the ribs to find the channels. Performing the necessary downwardly twisting action secures the external part over the internal part and hermetically seals the system again.

The complete rib or the intermediate rib can include a common quality which would allow the closure to be reclosed by a straight snap-on action. When the external part is axially upwardly projected and complete ribs are positioned in the channels, or when the intermediate ribs are over the outwardly disposed flange, an axially downwardly snap-on hit over the external part would make the ribs pass over the outwardly disposed flange containing the channels. This is the case either when the ribs are positioned over the lifting ring that contains the channels (first case) or when the ribs are positioned in the channels (second case). The tensions and forces of the plastic to be used for the closure partially determine that a first snap-on action would make the force applied over the external part and thus over the ribs positioned over the lifting ring of the internal part cause the segments belonging to the skirt of the internal part to grip the extreme of the bottle. After the skirt has gripped the bottle, a continual but harder snap-on force would make the ribs positioned either over the lifting ring or in the channel belonging to the lifting ring pass over the lifting ring until reaching a closed status. The ribs may have a round shape along their inferior side which will confront the lifting ring during the snap operation. Thus, the passing over action of the ribs towards the lifting ring will be facilitated. This would provide the system with a quick way for re-capping the closure while maintaining all the advantages previously described that make this closure unique. Often, the elements specified in a capping system to achieve technical goals dictate processes to be performed even when the desired goal has already been achieved. With a commonly known screw cap, a long twist operation is required to release the closure during the opening process and perform the venting operation. The consumer should not have to re-cap the closure with a complementary analogous screwing process having the same degree of difficulty when there is no technical reason for making the re-capping process equally as difficult as the de-capping process. The consumer, after complimenting security procedures, should instead be able to perform, in a more comfortable way, re-capping of the closure.

The snap-on possibility presented by this system affords the consumer safety when it is needed during the venting process but allows the consumer to handle the closure most conveniently when no more safety or other technical specifications need to be accomplished. Certainly, all the rest of the qualities of the system will still be observed.

The existence of either complete or intermediate ribs has the purpose of avoiding the possibility that someone, voluntarily or not, could make the closure pop-off from the bottle as a result of the positive or carbonated pressure contained inside the container. The presence of the ribs dictates the unique way in which the external part could be upwardly projected up to a level at which the skirt of the internal part is allowed to flex and be released from the extreme of the bottle. Ribs must be conducted through their complementary channels to allow the external part to reach the projected level. During this transition process, venting activity is observed since there is no more hermetic pressure of the internal liner over the bottle. By the time the ribs have been totally conducted through the channels, enough pressure will have been released so to avoid the possibility of popped-off caps. The ribs exist solely for the purpose of a secured venting process, not for hermetic reasons or any other technical cause. Hence, disposition of such ribs and channels can be designed in order to maximize and optimize the purpose for which they were conceived. Both a structure including the complete rib disposition and with a structure including the intermediate rib disposition, a consumer will be able to handle the closure in a way that will allow regulation and control of the ratio or intensity of a venting process during an opening movement. The common situation in which splashes of the liquid from inside of the container during the venting process when carbonation is present and when the container has been shaken or exposed to high temperatures is avoided.

After the breach line is broken, either the superior oblique border of the complete rib or the top extreme of the intermediate rib can be axially pulled by a pure vertical movement towards the lifting ring containing the channels through which the ribs are going to be conducted. A resultant force elevates the internal part in a small but sufficient way so as to release the pressure applied by the internal liner, present in the ceiling of the internal part, over the perimetric area of the extreme neck of the bottle. This allows the positive pressure of carbonation present inside the container to be gradually freed through the vertical ducts present in the internal part. By pulling up or pushing down the external part, ribs, complete or intermediate, may or may not put pressure towards the lifting ring in a venting action, depending on the consumer's perception of the convenient ratio or intensity of venting activity. The capability of the consumer to choose this intensity of venting activity allows him or her to avoid being splashed as a result of a sudden venting activity that would release fluid from inside of the container. Each bottle opened by the consumer has been exposed to particular situations before the precise moment when the consumer takes it. When the consumer chooses the bottle, the consumer does not know whether or not the bottle has been exposed to a high temperature, movements or shaking. To minimize the probability of sudden splashes of fluid when the bottle has been exposed to the previously mentioned aleatory situations, this system provides a way for the consumer to regulate the intensity of the venting process according to what he or she observes at the very first venting instance.

Additionally, a particular structure that is present in the roof of the internal part of the closure and, in a complementary way, in the ceiling part of the external part is disclosed. Both structures are disposed in a complementary pattern, since, as many other structures of the system, when both parts of the closure are joined in a closed position, these complementary structures will cooperate and appear as one. Many units of complementary structures are present in the system, and it is intended here to define another one which will opportunely guide the rest of the complementary units to a proper joined status. The interaction to be observed, at any time of the handling of the closure that will activate the different tools, devices and mechanisms that define the qualities of the system, will be contained or guided by this main pattern which determines the positions of the parts relative to each other at the capping stage. At the same time, when the internal and external structures are joined, the complementary structures will eliminate the possibility that the central circular area of the external part will rotate during the opening process when the annular area of the external part is twisted. Hence, the correct breaking of the tamper evidence breach line is assured.

The venting process is improved by a modification in the design of the slots across which the positive pressure or carbonation contained inside the bottle is freed. This allows the venting process to be enhanced during a first stage of the opening operation in which, due to the nature of the closure, venting must be maximized.

The disposition and quantity of the channels in relation to their complementary ribs is defined in a pattern according to what in known as a mathematical geometric sequence. The usage of this geometric sequence in a closure design, as is the case here, determines a relative positioning and a quantity correlation between the two interacting technical devices. Since this interaction is critical to correct performance of the system, this pattern is chosen to define the nature of the mentioned relation and to optimize the situation.

DESCRIPTION OF THE PREFERRED EMBODIMENTS

Figure 1A:
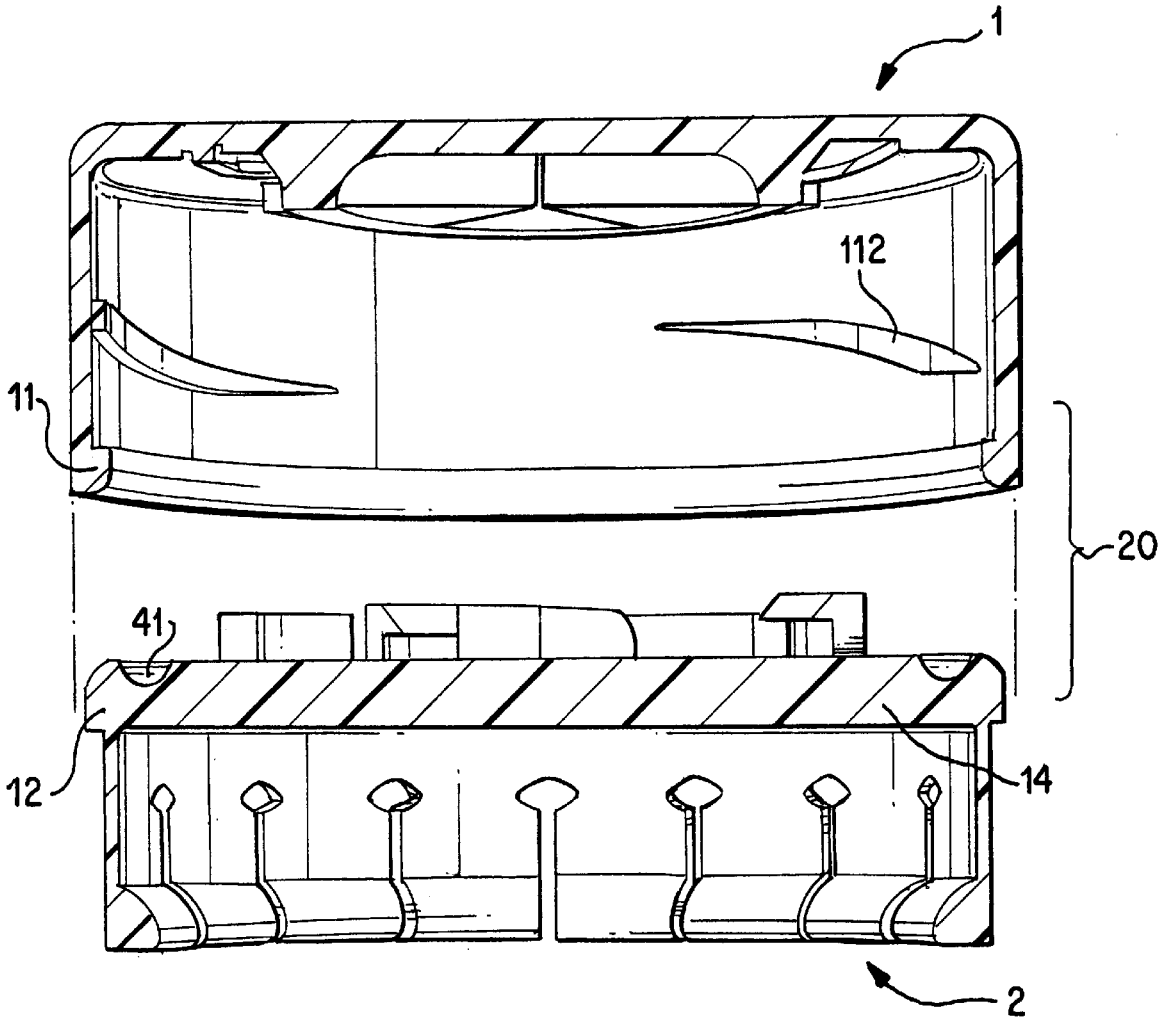
FIG. 1A is an exploded sectional view of the closure illustrating the process of assembling both parts of the system and in which the parts are about to be clamped to each other.
Figure 1B:
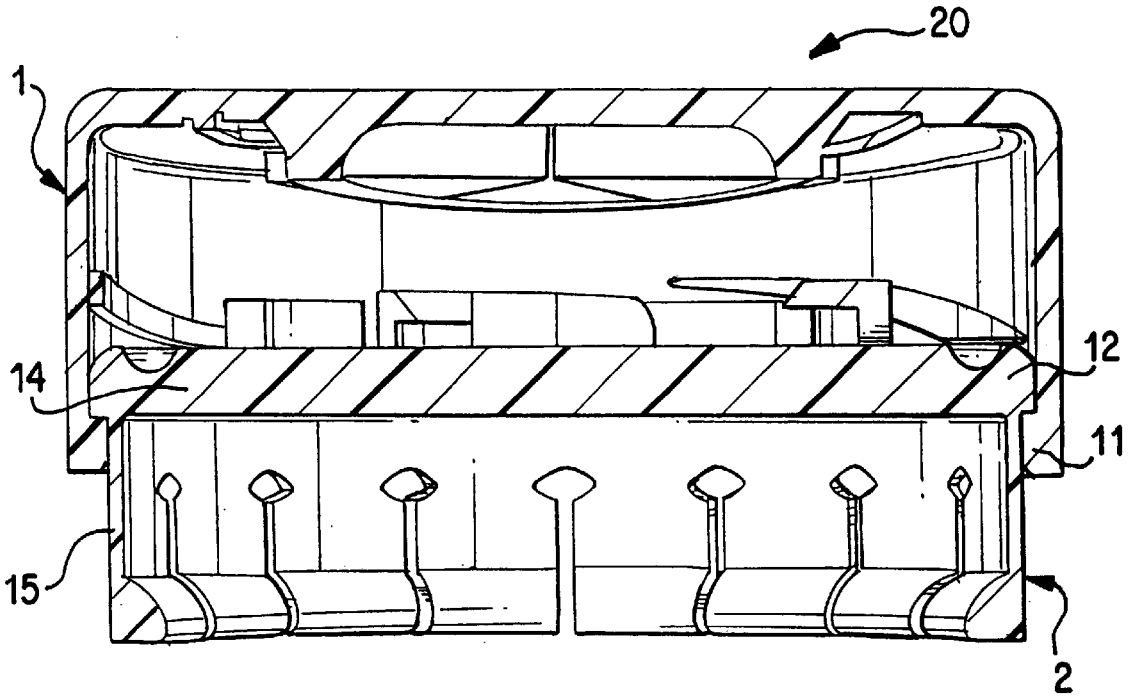
FIG. 1B is a similar view but showing the parts after they have been joined or clamped together.

FIGS. 1A and 1B show both parts of the cap 20 before they are clamped to each other to become a functional closure. Important structures in these two figures are the binding ring 11 belonging to the external part 1 and the lifting ring 12 belonging to the internal part 2. As has been mentioned, the improvement in the design of these two rings is the convex shape or design that each of these structures has. When such convex designs interact during the assembling process, the binding ring 11 can easily pass over the lifting ring 12 as a result of an impulse or snap hit over it during the bottling process. Lifting ring 12 has, around its perimeter, spaces or channels 51 as can be observed in FIGS. 4A and 4B. These channels 51 can be present at more than one point on the perimeter. The mass remaining between each channel 51 will be the flange over which the binding ring 11 will have to pass during the assembling process. Convenient inter-disposition shapes of the binding ring 11 and the lifting ring 12 and a convenient small size of the remaining flanges on the lifting ring 12, between channels 51, over which the pass of binding ring 11 will be relatively easy to accomplish. Flexibility of lifting ring 12, to allow the assembling operation, is enhanced by a diminished thickness of the main plate 14 caused by the existence of a perimetrical groove 41 in a round path before the lifting ring 12.

This perimetrical groove 41, shown in FIGS. 1A, 1B, 3A, 4A and 4B, for example, provides an all around downward flexibility to the lifting ring 12 and to the skirt 15 depending from it.

The assembling techniques and operations can be performed by a snap hit over the external part 1 after it is positioned over the internal part 2. As a result of such a snap hit, binding ring 11 will-easily pass over lifting ring 12. During the pass over process, the lifting ring 12 will flex to allow the binding ring 11 which flexes as well to completely pass. This flexing action is caused by the complementary convexity of the facing structures, the small size of the remaining mass between the channels 51, the existence of the perimetrical groove 41 which adds flexibility to the lifting ring 12, assembling techniques, and flexibility of both parts as a whole. Once the binding ring 11 has completely passed over the lifting ring 12, the rings become interlocked in such a way that will never be able to be disjoined again.

Figure 2:
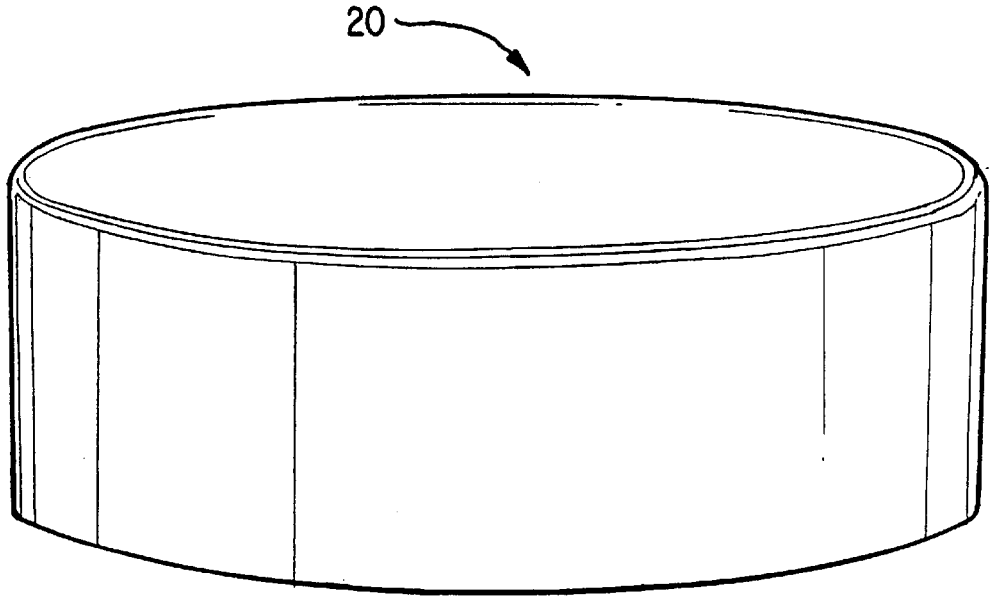
FIG. 2 is a perspective view of the complete closure showing the smooth top or roof of the external part of the closure or cap.

In FIG. 2, the complete closure is observed in a closed state. The specific detail shown in this drawing is the external part 1, which now offers a complete and smooth roof. This is an improvement upon prior external parts which had a hole or perforations in the center.

Figure 3A:
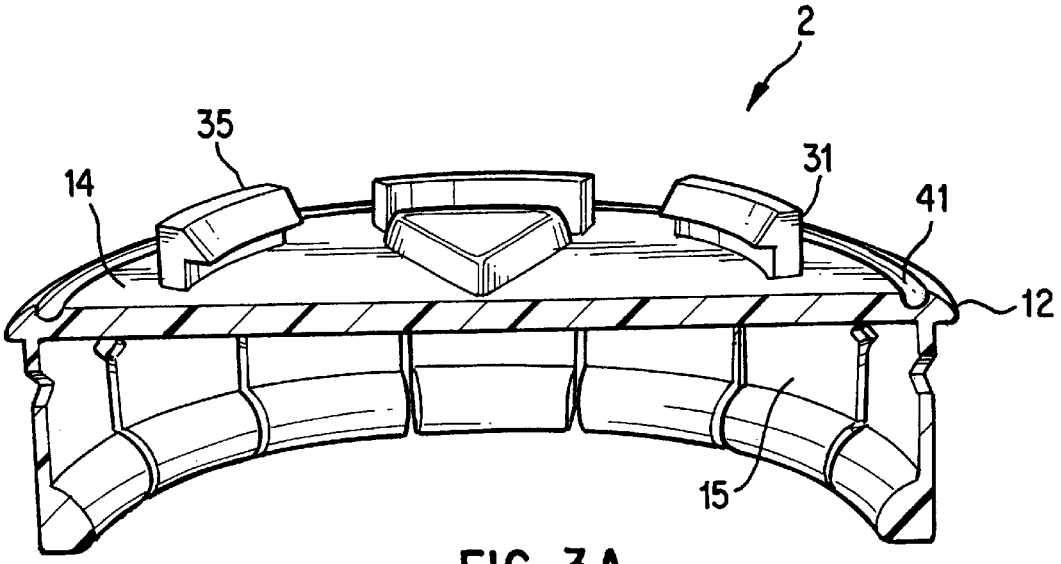
FIG. 3A is a sectional view of the inner portion of the closure or cap and illustrates the alternating hooks on the upstanding flanges.
Figure 3B:
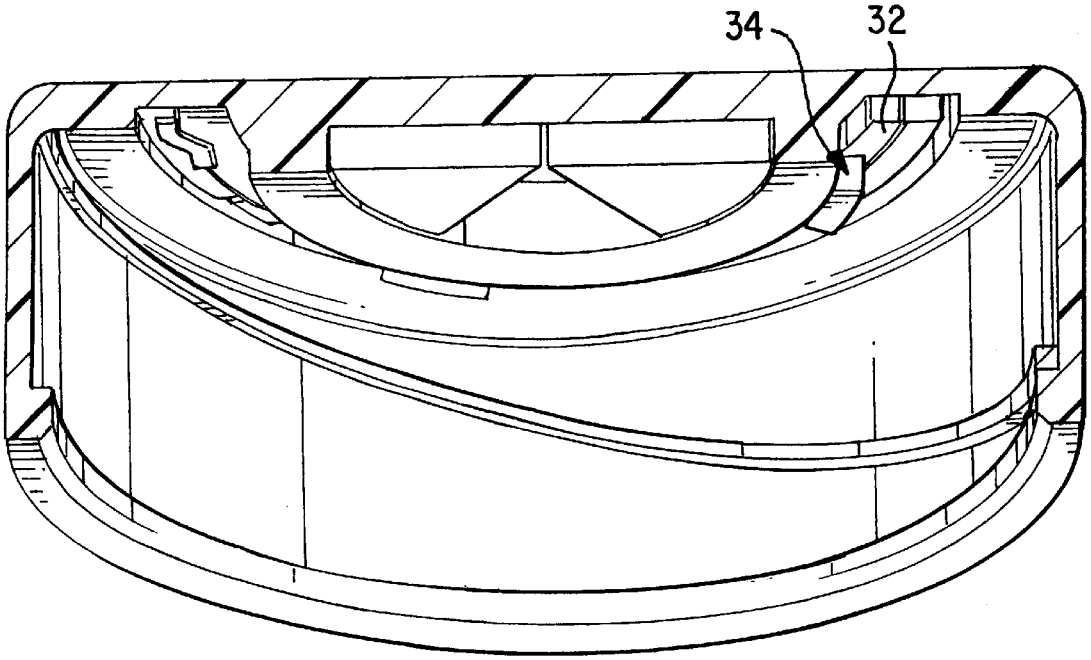
FIG. 3B illustrates complementary alternating grooves defined by flanges on the outer part into which the hooks on the flanges are received.

In FIG. 3A, the internal part 2 is shown as including the alternated disposition for the upstanding flanges 31 conceived to hook in complementary grooves 32 present at the ceiling of the external part 1 shown in FIG. 3B. This alternated disposition is applied for the hooks 35 present in the extremes of the upstanding flanges 31. There exist upstanding flanges between the mentioned flanges 31, but these other flanges do not have the hook on their extremes. As there are non-hooking flanges between the upstanding flanges 31, there are complementary spaces in external part 1 between the parts 34. The hooks 35 belonging to the upstanding flanges 31 will engage in the parts 34 securing the external part to the internal part.

This alternated pattern responds to the necessity presented by the machinery to mold the two parts. Every time that an undercut is created upon a tool, such tool must be able to be freed from such undercut after the structure is created. The possibility presented here is for a rotational operation of such tool to free the tool from the recently created undercut without spoiling the undercut on the way out. After creating the mass, the tool can go out through the space.

In FIG. 3A, moreover, internal part 2 is shown as including the above-mentioned perimetrical groove 41. This perimetrical groove 41 can be present in the external top face of the main plate 14 or could be present in the internal face of such main plate 14. The object of this groove is to provide flexibility to the internal part 2. Two aspects of this flexibility are to be noted. The first aspect is applicable to the lifting ring 12 and skirt 15. The second aspect is applicable to the main plate 14.

The flexibility aspect for the lifting ring 12 and skirt 15 is important during the assembling process as described above. The second flexibility aspect on the main plate 14 is important, during closing and releasing operations, when the external part 1 performs over internal part 2. This second aspect can be referred to as the arch action of the internal part 2. This arch action is observed in the main plate 14 as a result of the binding action of the binding ring 11 over the skirt 15. The length of the skirt is a little bit shorter than that needed to comfortably lay in the groove 9 of the bottle. Thus, during the bottling operation, the extremes of the skirt 15 must be bound by the sliding down of the binding ring 11 to remain locked in the groove 9 of the bottle. In this state, the internal part 2 is in an arch tension. When de-capping occurs, the binding ring 11 slides upwardly, allowing the skirt 15 to upwardly flex and move from the groove 9. The arch tension previously allocated to the main plate 14 during the closed status of the system is relieved, making the skirt 15 return to its original state shown in FIGS. 5A–5E. As the skirt 15 reacquires its original shape and expands, it slightly pulls up or elevates the external part 1 which will have been in the opening process.

Figure 4A:
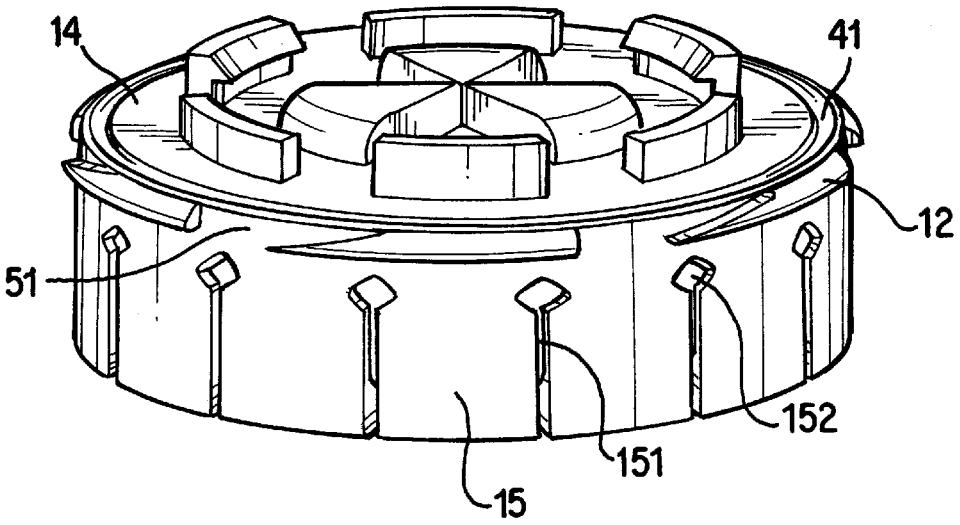
FIG. 4A is a sectional view showing the inner part of the cap with the mold oriented design of the channels evident.
Figure 4B:
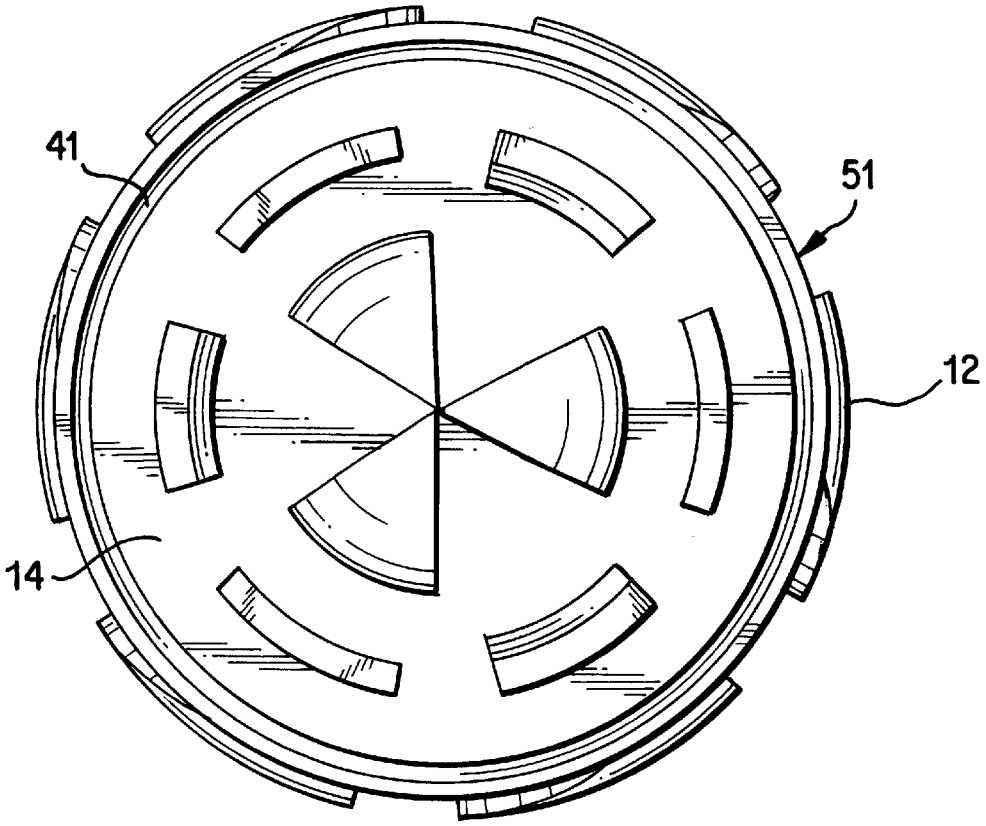
FIG. 4B shows the same inner part from the top and illustrates the disposition of six channels around the circumference of the inner part.

In FIGS. 4A and 4B, the internal part 2 makes evident the design of channels 51. The machinery for producing this undercut is less complex than that needed to produce the previously utilized channels. The left side of each channel 51 allows the machinery needed to create this undercut to be simple and, according to state of the art, with known tools.

FIGS. 5A–5E show the disposition for the skirt 15 vertically disposed from the main plate 14 of the internal part 2. This special disposition of skirt 15 will provide a better interaction of the internal part 2 with the bottle, making it easier to grip such an internal part 2 to such bottle, as well as to de-cap the closure from it. In both cases, the external part will be upwardly projected so that the binding ring 11 does not surround the cleats of the skirt 15. Further, this disposition is part of the arch effect of main plate 14 described above. When skirt 15 is radially outwardly disposed, the main plate 14 is straight. When the cleats of skirt 15 are surrounded be the binding ring 11, in a closed status, then, by action of the perimetrical groove 41 that provides flexibility, main plate 14 will be the one flexing. This arch action will enhance hermetic capabilities when the closure is closed, and will make the system almost automatically help the consumer in releasing the closure when this operation is performed. If a tension of the main plate 14 is held during the closed status, then when segments 92, shown in FIG. 10B, of the breach line 91 are broken, and the binding ring 11 is lifted upwardly by the effect of the perimetrical groove 41, the main plate 14 will recover its original straight status. The skirt 15 will as well.

Figure 6A:
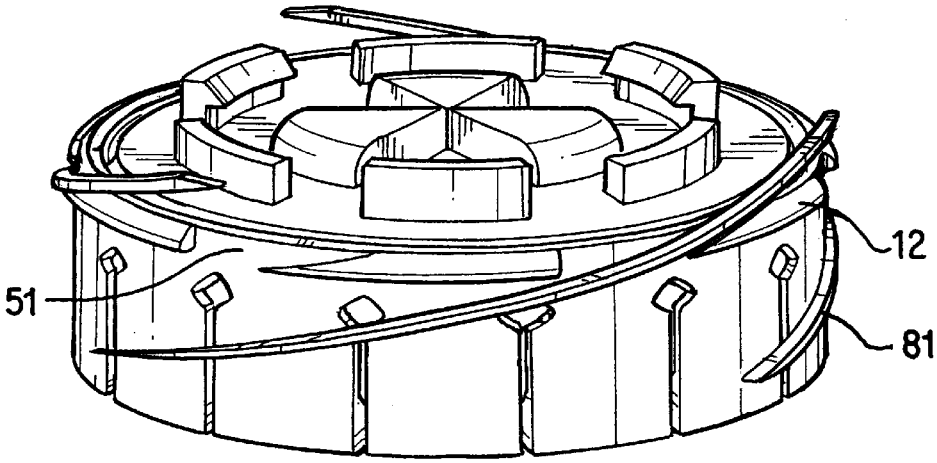
FIG. 6A is a view representing the interaction of internal complete ribs present on the external part and the channels defined in the internal part when the closure is in a closed state.
Figure 6B:
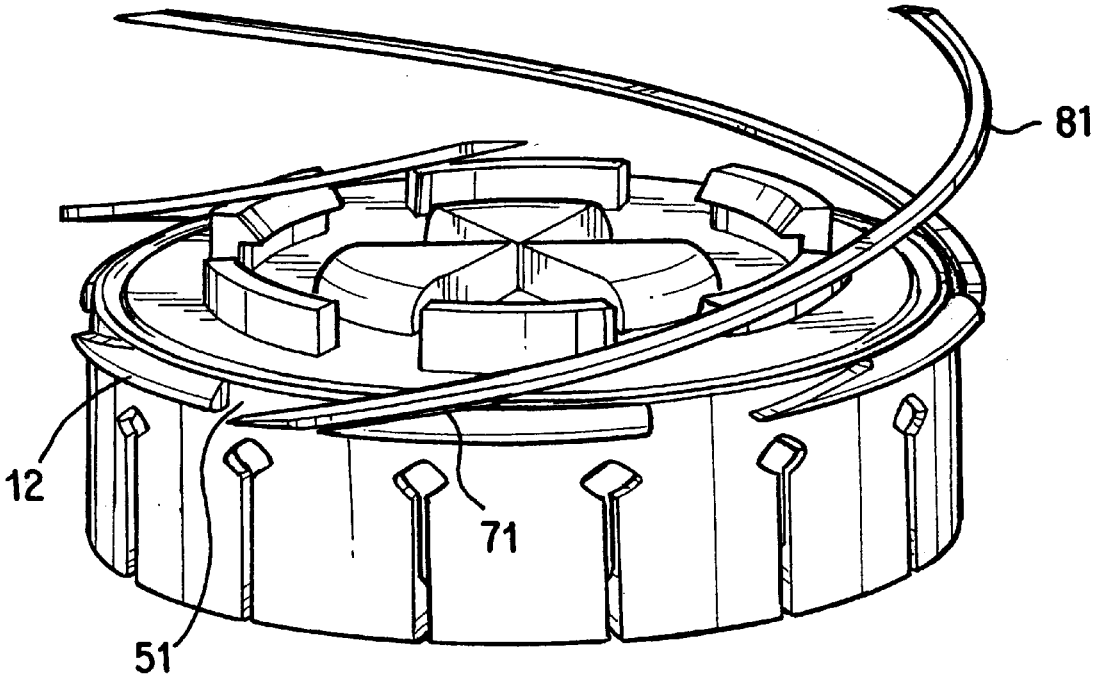
FIG. 6B is a similar view but showing the interaction when the system is in an open state.
Figure 7:
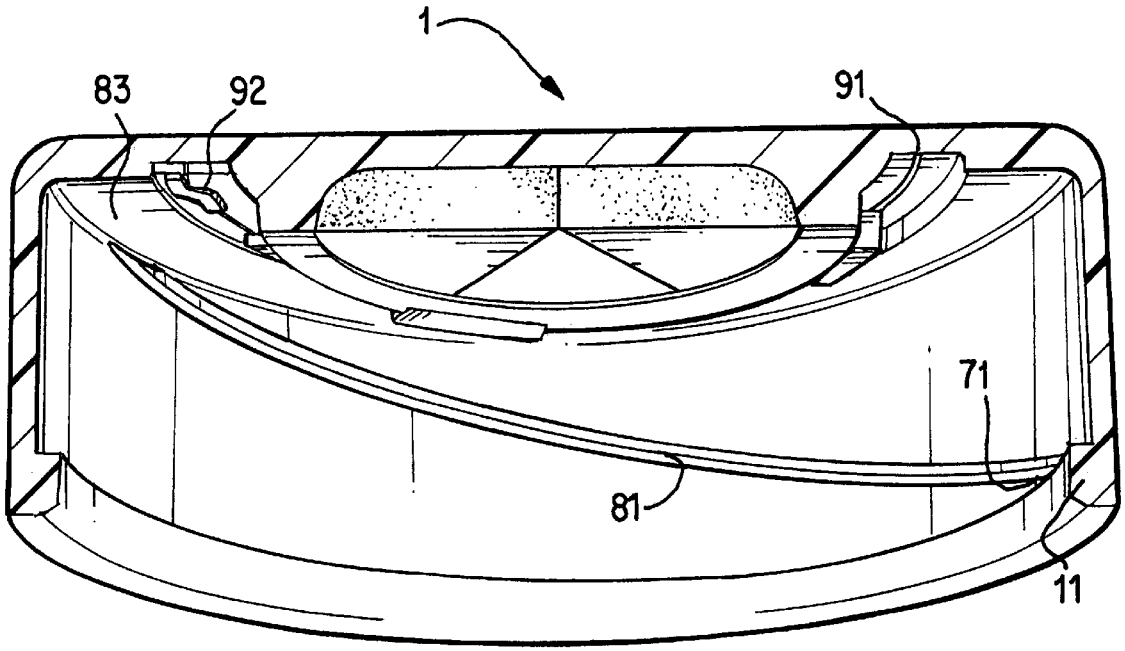
FIG. 7 shows how the complete rib is disposed on the interior wall of the outer closure part.

FIGS. 6B and 7 show how the bottom part of ribs 81 has a special step 71 that interacts with the complementary channel 51 in such a way that the external part 1 will stay telescopically projected over the internal part in the mounted position, as shown in FIG. 1B, until the closure is voluntary closed. Either with a twisting action or by a snap-on action that will make the ribs 81 pass over lifting ring 12, the ribs 81 belonging to the external part 1 will take their closed state positions as shown in FIG. 6A. The existence of step 71 assures the stability of the closure in the mounted position. An increased thickness of the lower part of the rib, moreover, would provide frictional force to maintain the projected status of the cap until a voluntary action changes that status.

Figure 9A:
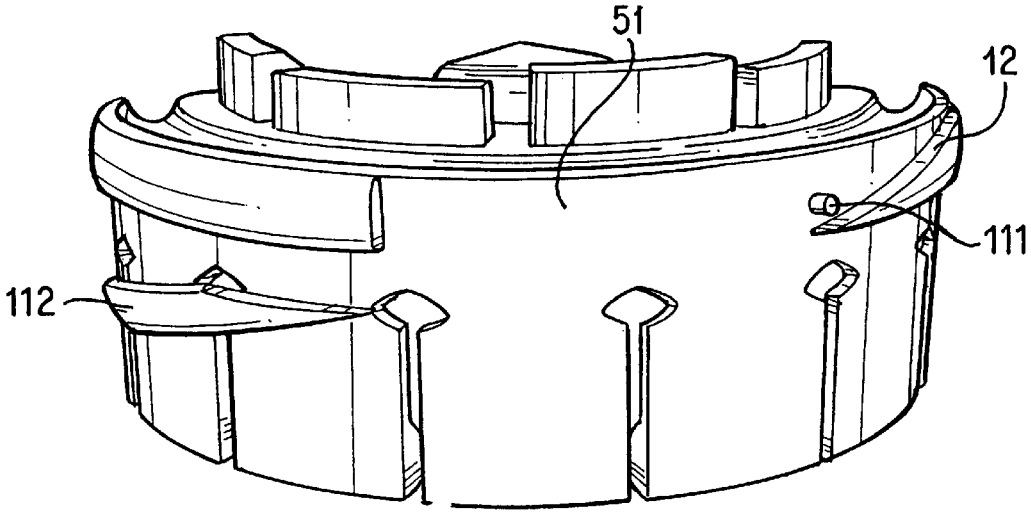
FIGS. 9A–9D are views which show the disposition of the intermediate ribs relative to corresponding channels in different stages of opening the closure.
Figure 9B:
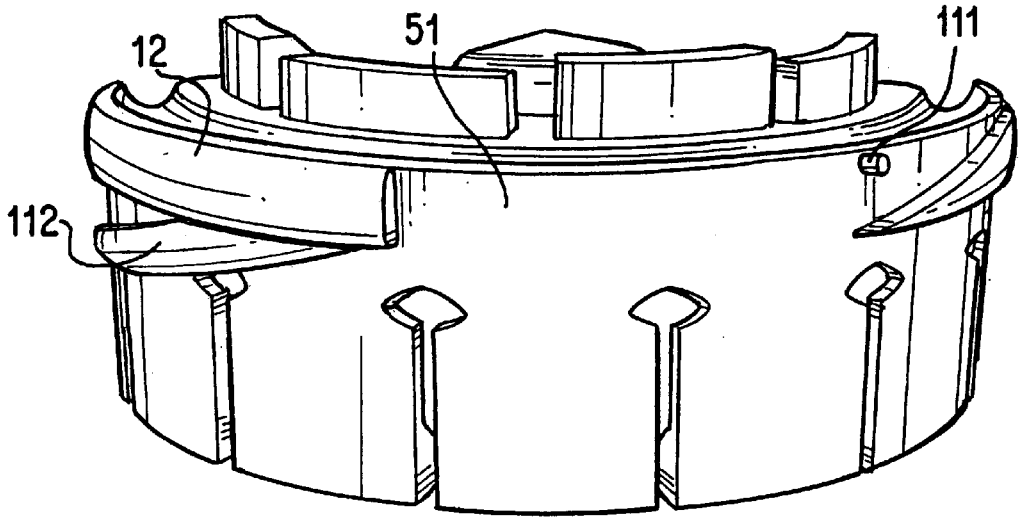
Figure 9C:
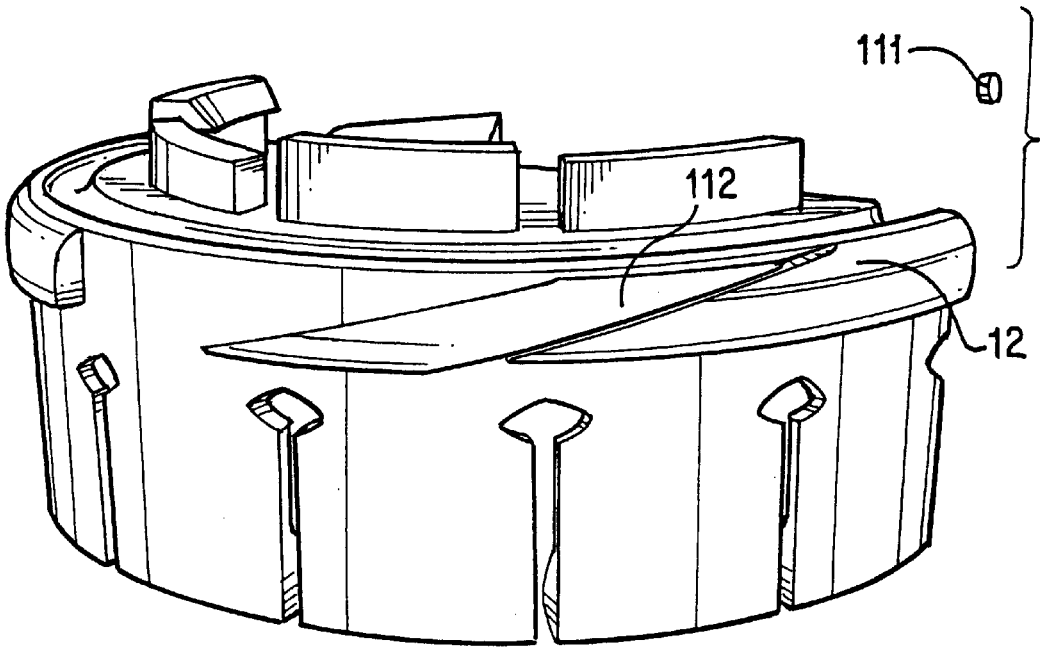
Figure 9D:
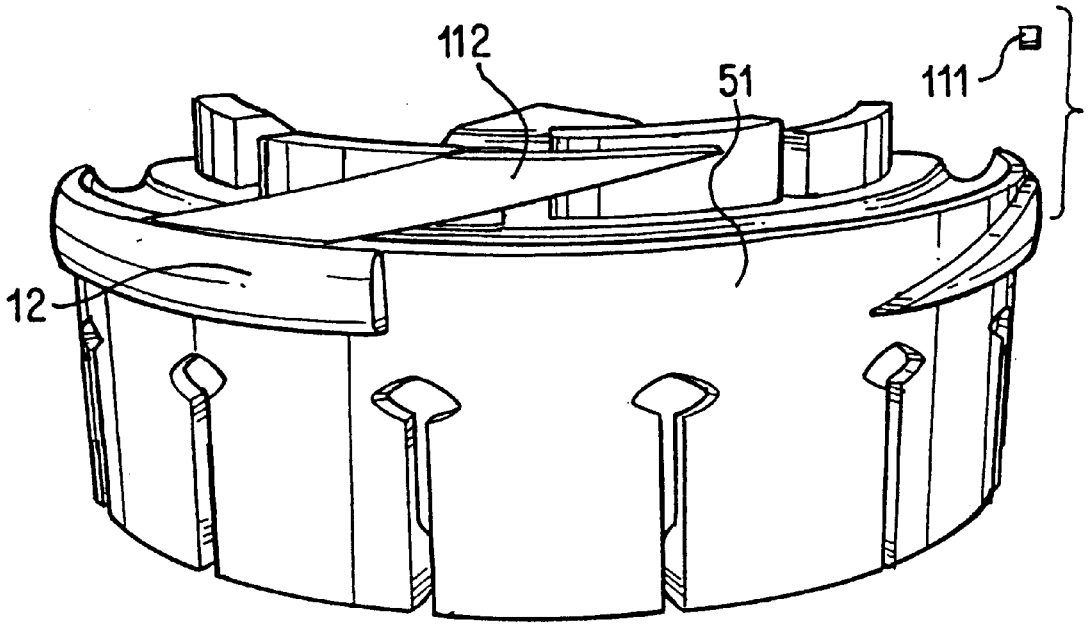

A similar aspect is noted in FIGS. 9A–9D in which the same principles are applied but a shorter rib 112 is present. Rib 112 is completely positioned over the lifting ring 12 in the mounted position state as is shown in FIG. 9D. The closure remains in the illustrated position until a voluntary twist or snap-on operation is performed to close the system as shown in FIG. 9A.

FIG. 7 shows the design for the complete ribs 81. Ribs 81 start at the binding ring 11 and end at the roof 83 of the external part 1. At the first stage of such ribs 81, a step 71 is provided. In this first stage, the rib 81 has an assigned thickness that grows bigger at the mentioned step 71. The larger thickness remains until the rib 81 reaches roof 83 of the external part 1. The specific quality to be noted is that ribs 81 go through the lifting ring 12 when in closed or compressed status and continue beyond it until they reach their ends. Segments 92 of the breach line 91 defined in the external part 1 will never be broken by an aleatory hit over the annular area defined outwardly from the breach line 91. This is because the annular area is supported by the interaction of the ribs 81 and the lifting ring 12. A similar situation is apparent from FIG. 9A, where a dot 111 belonging to the external part 1, and specifically positioned in a convenient place in relation to rib 112, is supported by the lifting ring 12. Again, no aleatory hit over the external part 1 will make the breach line 91 break down and ruin the closure. This dot 111 also performs as a guide for the intermediate rib 112 to find the path through the channel 51 even if the consumer performs a pure twisting action without applying a pulling force. The dot 111, in other words, acts as an extension of the intermediate rib 112 imitating the complete rib 81.

Figure 8A:
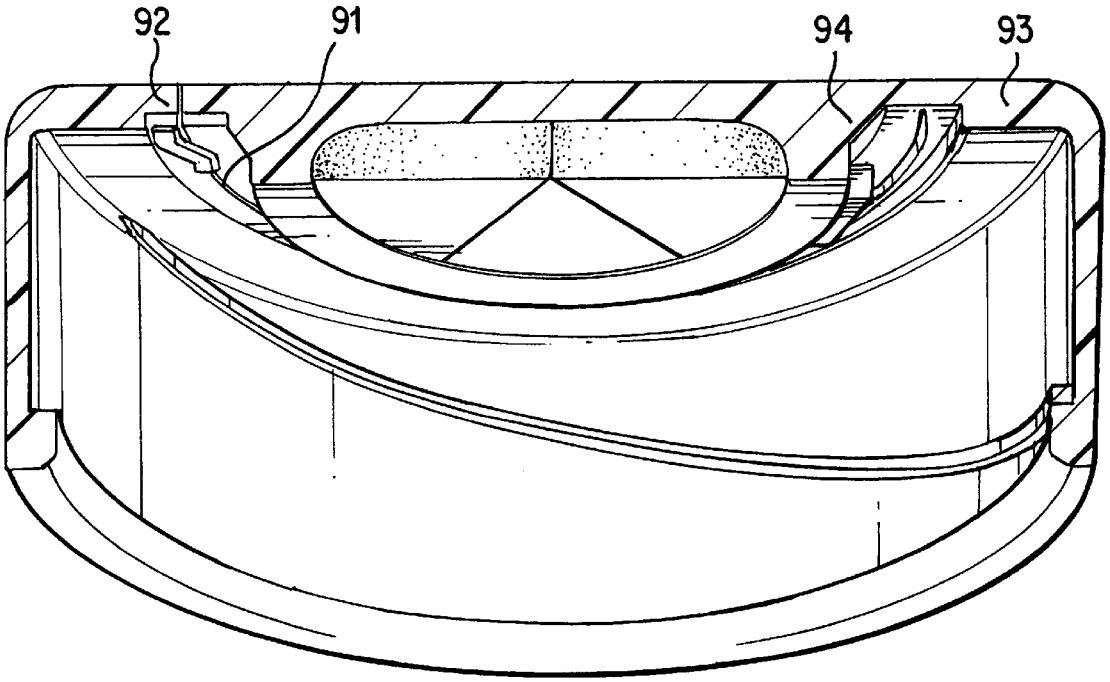
FIGS. 8A and 8B are internal sectional views of the ceiling of the outer part of the closure showing the disposition of the segments which are detached during a counterclockwise twisting action to break a breach line forming the tamper evidence device.
Figure 8B:
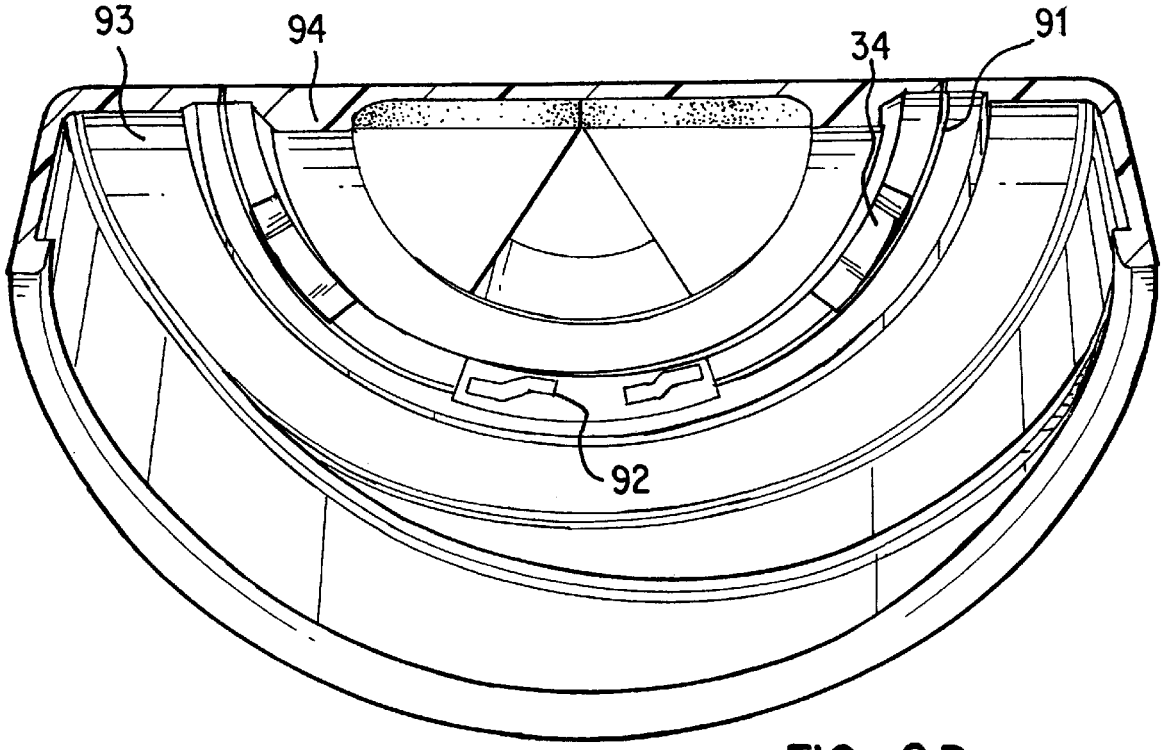
Figure 10A:
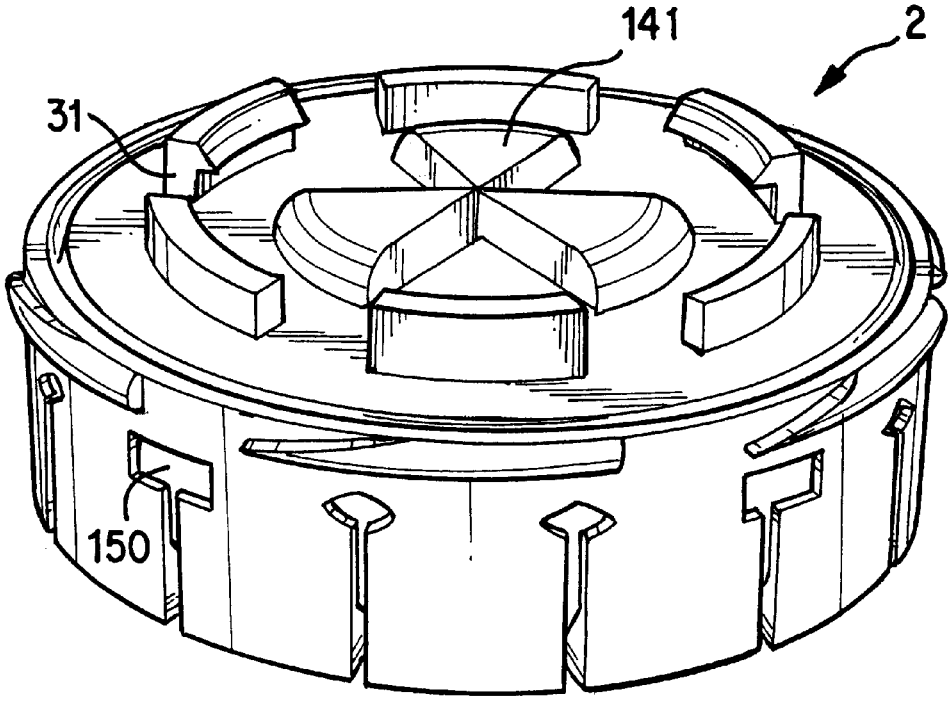
FIGS. 10A and 10B show the complementary structures to be joined which are present on the roof of the internal part and on the ceiling of the external part.
Figure 10B:
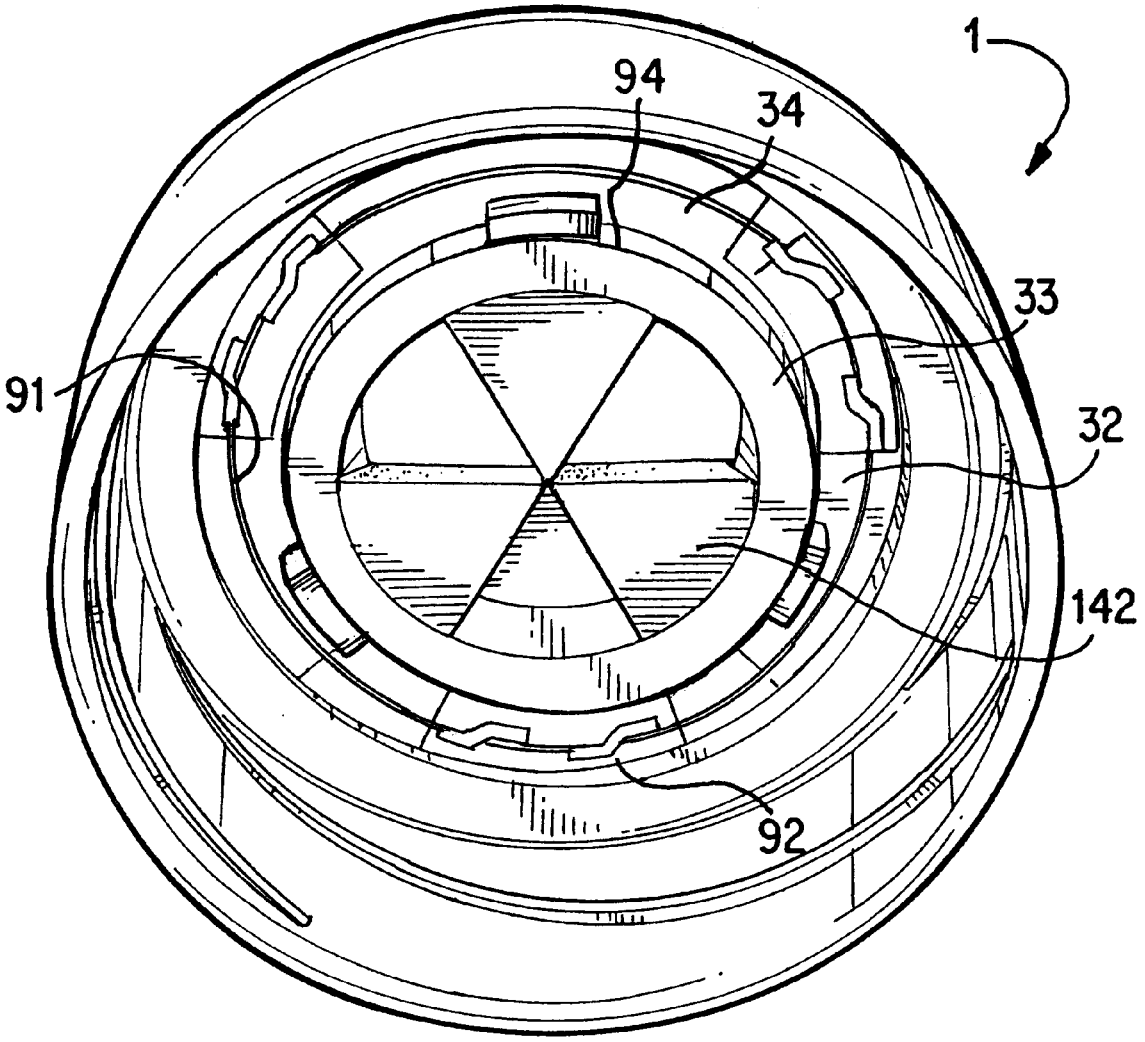

FIGS. 8A, 8B and 10B show segments 92 disposed in pairs along the breach line 91, which defines an already partially cut space between external annular area 93 and central area 94. This cut can be done during the production process when the piece is still in the mold. A circular blade can be projected from the mold to define the breach line. After the cut is done, the circular blade retires to its original position inside of the mold. The still soft conformation of the raw material due to the molding process allows the cut to be done and, after that, will try to recover its previous status by joining the walls defined by the cut, but without mixing the "after-the-cut" separated molecules. The cut will be almost imperceptible to the view, but still present. In the spaces between the pairs of segments 92, parts 34 are provided so as to define locations where upstanding flanges 31 will hook. This situation is fully evidenced in FIG. 10B. The segments 92 specify an oblique configuration in their centers, during the transition plane from the external annular area 93 to the central area 94, which will maximize the stretching performance to allow the external annular area 93 belonging to external part 1, to twist counterclockwise. Breach line 91 acts as a space boundary over segments 92 that specifies the point where the stretch of such segments 92 will be applied. The part belonging to the central area 94 of external part 1, will remain in place since such central area 94 does not rotate. The part of the segment 92 belonging to the external annular area 93 will rotate attached to such external annular area 93, producing the stretch in the oblique part of segments 92.

FIGS. 6A, 6B and 7 show the disposition of the complete ribs 81 around the closure. Ribs 81 belong to external part 1. In FIGS. 6A and 6B, the rest of the structures of the external part 1 have been disregarded to focus on the interaction between the mentioned ribs 81 and the channels 51. FIG. 6A shows the position that ribs 81 will have when the closure is in a closed status. The free space at the bottom of the ribs 81 is the one that the binding ring 11 will occupy. The free space at the top of the ribs 81 over the lifting ring 12 is the one observed until the ribs 81 reach the roof 83 of the external part 1. A counterclockwise twist of the external part 1 to release the cap will lead the ribs 81 through channels 51 until the binding ring 11 reaches the lifting ring 12, as shown in FIG. 6B. This one is the only possible and unequivocal operation that the consumer will be able to perform to release the system. After a complete twist is made, steps 71 engage the lifting ring 11 as shown in FIG. 6B. In this state, the closure can be easily released. If the consumer wants to re-cap the closure, he or she will be able to do so either by twisting the external part 1 clockwise to allow the ribs 81 to go back through channels 51 to their original state, or by snapping the cap back on with a hit over the external part 1 so to make ribs 81 pass over lifting ring 12 in a vertical axial way and become positioned in another channel different from the one in which each rib originally was, so as to be ready to perform the opening movement again.

FIG. 9A shows the system in the same state as shown in FIG. 6A, but with the presence of the intermediate ribs 112 instead of complete ribs 81. Intermediate ribs 112 do not start from the binding ring 11 and do not reach the roof 83 of the external part 1. They are defined in an intermediate place from the binding ring 11 belonging to the external part 1 and the lifting ring 12 when the system is in closed status. As the external part 1 is twisted and lifted to release the system, intermediate ribs 112 interact with lifting ring 12. Associated with intermediate ribs 112, and belonging to the same external part 1, are dots 111 that are positioned over the slope of lifting ring 12 to guide intermediate ribs 112 in convenient sequential movements towards the channels 51 through which the intermediate ribs 112 should be conducted.

As the counterclockwise twisting operation is performed, dots 111 will make the external part 1 containing intermediate ribs 112 lift towards the necessary point where intermediate ribs 112 will unequivocally reach the starting point of channels 51. Once the counterclockwise twist has been performed to make the intermediate ribs 112 pass through channels 51, the binding ring 11 releases its binding action over skirt 15, making release of the closure possible. Intermediate ribs 112 will be positioned as shown in FIG. 9D. In this situation, the binding ring 11 belonging to the external part 1 will be positioned towards lifting ring 12 from the bottom side in order to release the closure by pulling the external part 1 up. After consuming part of the product inside the container, if the consumer wants to re-cap the bottle, then he or she will have to position the closure over the bottle, and either twist the external part 1 clockwise to conduct intermediate ribs 112 through channels 51, or downwardly snap-on the external part 1 to make intermediate ribs 112 to pass over lifting ring 12 until they reach the original closed status observed when the system was hermetically positioned over the extreme of the bottle, in a situation similar to the one observed in FIG. 9A.

Shown in FIGS. 6A and 9B is a principle that allows the consumer to regulate the intensity that he or she thinks convenient to assign to the venting process according to the particular pressured or carbonated status of the beverage that they are about to open.

Each bottle is filled in the bottling plant with an assigned amount of pressure. This pressure, moreover, can vary according to the temperature to which the container is exposed as well as with movement or shaking situations to which the bottle is exposed. Usually, the consumer does not know the intensity of these factors that directly determine the intensity of the venting process that will be held when he or she releases the system. It is common when a consumer releases the closure for fluid from the inside to splash out if the aleatory situations above mentioned had happened.

When the closure is in a closed state as shown in FIGS. 6A and 9A, complete ribs 81 are positioned over channels 51 or intermediate ribs 112 in the expected compressed status. In this situation, after a short counterclockwise twist is applied to break the segments 92 of the breach line 91, a pure vertical movement—without twisting action of any sort—can be applied to make either of the ribs apply force towards the lifting ring 12. In the case of intermediate rib 112, see FIG. 9B. In this situation, binding ring 11 will not be lifted enough to release its binding action applied over skirt 15. Thus, even when considerable positive pressure is observed inside of the bottle, the closure will not pop-off, for skirt 15 can not expand to release the extremity of the bottle. However, the venting process will be held as a result of the slight lifting action observed on the internal part 2 as a result of the interaction of ribs and lifting ring 12. Internal liner 121 will be slightly moved from the extreme border of the bottle and, hence, will allow positive pressure to be released from inside of the bottle in a controlled manner. If the intensity of venting the pressure inside of the bottle is extremely high, then by pushing down the external part 1, ribs 81 or dots 111 belonging to the external part 1 will apply a downwardly force over the slope of the channels 51 belonging to lifting ring 12 of the internal part 2 which has the internal hermetic liner 121 attached on it's ceiling.

By vertically pulling the external part 1 and vertically pushing the external part 1, the consumer can regulate the intensity with which the internal hermetic liner 121 present in the ceiling of internal part 2 seals the extreme of the bottle. After the segments 92 of the breach line 91 have been broken by a short twist, if the external part 1 is vertically pulled up, then the venting process will start with a high level of control over such process. If, due to aleatory circumstances, the intensity of such a venting process is higher than is convenient, then a consumer can quickly diminish such intensity by downwardly pushing the external part 1 by applying pressure so as to replace the internal hermetic liner 121 over the opening of the bottle.

FIGS. 10A and 10B show structures with a clover shape. These structures are present on the roof of the internal part 2 and on the ceiling of the external part 1. The structures are complementary to each other and will become interlocked when the structure is joined and placed in a closed state. As a result, clover 141 belonging to internal part 2 and clover 142 belonging to external part 1 will fit between each other when external part 1 completely covers internal part 2 in a closed state. During the joining operation, upstanding flanges 31 belonging to internal part 2 will hook in alternated parts 34 belonging to external part 1. Central area 94 will now be immobilized and unable to be elevated since upstanding flanges 31 hook on parts 34 and are not able to rotate when a twisting opening action is performed over the external part 1. This is because the complementary clovers interlock with each other. Hence, when twisting action of the external part 1 is completed, segments 92 are going to be stretched to broke, activating the tamper evidence device.

The specific pattern in which internal clovers 141 can complementarily join external clovers 142 dictates the convenient pattern with which the rest of the complementary structures disposed in the rest of the system will conveniently join. The shapes of these structures can be modified according to the chosen number of upwardly disposed flanges 31 and complementary parts 34. If three upwardly disposed flanges 31 are disposed around the main plate 14, then a clover's shape would be the correct shape to assign to the structures described herein. If the number of upwardly disposed flanges 31 is to be four around the main plate 14, then four parts 34 will be present, and a convenient shape for the structures described here will be like a cross formed by four triangles joined in the center. This cross pattern will provide four possibilities for the clamping action between the upwardly flanges 31 and the complementary parts 34.

These complementary structures of the roof of the internal part 2 and the ceiling of the external part 1, are critical to good performance of the system. Its shape is defined by the number of ribs chosen to be present in the external part 1 and by the number of upwardly disposed flanges 31 to be present in the main plate 14 of the internal part 2. The number of ribs and the number of upwardly disposed flanges must be related directly. When the number of ribs is a pair number, then the number of upwardly disposed flanges must be a pair number too. If this pattern of pair numbers is observed, then the shape of the structures on the top of the internal part and in the ceiling of the external part can be either a cross formed by four triangles or just two confronting triangles. This pattern will provide the possibility of a pair number of possibilities to clamp these structures between each other as well as the pair number of flanges 31 with the complementary pair number of parts 34.

If the number of upwardly disposed flanges 31 and, subsequently, the number of parts 34 is chosen to be not a pair number, like three (3), then the convenient shape for the structures present in the roof of the internal part and in the ceiling of the external part must be like a clover's shape. This shape allows the system to be clamped in three different possibilities. Ribs, then, will have to be defined in a non-pair number, as will the channels. It must always be remembered that the number of channels can only be equal to or bigger than the number of ribs.

There exists a strong inter-relation between these three complementary units of structures: ribs with channels, flanges 31 with parts 34, and structure present in the roof of the internal part with structure present in the ceiling of the external part. The number of objects present in the different structures must always be either a pair number for all, or a non pair number for all of three units. Alternatives are defined by a geometric sequence.

The nature of the interrelation of the three units of structures will now be analyzed. Each unit of structure has two complementary structures which interact. One structure is present in the internal part of the system and the other is present in the external part of the system. This interrelation of the three units of structure is critical because it will assure a proper closing operation of the system when machinery or the consumer snaps on the external part over the internal part to compress the closure towards a hermetic state. If this interrelation is not applied, then the system will not optimize some of the rest of the qualities sought.

The first structure unit includes the structures 141 and 142 present in the center of the roof of the internal part and in the center of the ceiling of the external part. The second structure unit includes the flanges 31 and the parts 34. The third and last structure includes the ribs 81 or 112 and complementary channels 51.

Assembling machinery will position both parts of the system in such a way that, when assembled to a mounted position, ribs will become positioned inside channels. Later, in the bottling plant, bottling machinery will hit the external part, once the internal part is positioned over the extreme of the bottle, in such a way that ribs pass over the lifting ring 12 until other channels are reached with their upper extremes. In this situation, the structures 141 and 142 defined in unit one will be fitted, and structures 31 and 34 defined in unit two will be hooked. The way in which the assembly machinery positions both parts in a way for effective assembly and compression is described later.

The second structure unit, which includes flanges 31 and parts 34, and the third structure unit, which incudes ribs and channels, are critical to the proper compression of the system towards a hermetic state. This is why the units must follow a pattern dictated by the shape of structures belonging to the first unit. These two units of structures are critical because the second unit must assure a correct hooking action to hermetically secure the system and fix the central circular area of the external part on the internal part when the tamper evidence is activated during the opening process. Unit three, including the ribs and the channels, must assure that when the internal and external parts are assembled, the lower parts of the ribs will be positioned inside the channels. After the snap closing hit, the top extreme of the ribs must be positioned in a subsequent channel in a ready-to-be-opened status. Opening can then be performed by the consumer with a counterclockwise twist.

The shape of the structures defined in the first unit will dictate the number of radial possibilities for both parts of the closure to fit in a closed status. For example, if the shape of the complementary structures is to be a clover as shown in FIGS. 10A and 10B, then three radial possibilities for making the complementary structures fit exist. Since, when the internal and external parts fit, flanges 31 must hook in parts 34, these flanges 31 and parts 34 must be distributed in such a pattern that, in either of three fitting possibilities for the internal and external parts, flanges 31 and parts 34 will efficiently operate. Hence, as shown in FIGS. 10A and 10B, flanges 31 and parts 34 must be aligned to the shape of the complementary clovers (in this case) 141 and 142. In this case, there are three flanges 31 aligned with the spaces between clovers of the internal part to which they belong and three parts 34 aligned with the mass of the clover in the external part to which they belong. Any of the three fitting possibilities of internal and external parts, which are specifically dictated by the clover's shape of the complementary structures 141 and 142, will assure that flanges 31 and parts 34 cooperate in a proper hooking action.

Now, maintaining the analysis pattern in which the first unit of structures is understood to have a clover's shape, the flanges 31 and parts 34 allocated in the described way must be observed. Focus will be made on how the third unit of structures must be disposed. The third unit of structures is the one including the ribs and the channels. An allocation pattern to provide for efficient interrelation must be found. In the same way that the shape of structures in unit one dictated the allocation pattern for the structures in unit two, structures in unit one will also dictate the allocating pattern for the structures in unit three.

As described above, the objective sought in the first state is to position the lower part of the ribs inside the channels (in the case of a complete rib) or over the lifting ring (in the case of an intermediate rib) during the assembling process as shown in FIGS. 6B and 9D to reach the mounted position. In a second state, the object is to make the upper extremes of the same ribs fit inside another channel, as shown in FIGS. 6A and 9A, when a closing operation is made by a snap action. After the snap closing action is performed, upper extremes of the ribs 81 must be positioned inside the following or subsequent channel ready to perform the opening operation. The specific channel in which the rib will be located after the snap action depends on the quantity of channels created and their allocation around the lifting ring. When in the mounted position state or in the closed/compressed state, ribs 81 must always be positioned inside of a channel.

During a snap on action, structures in units one and two efficiently join. For the intermediate rib 112, the mounted position state is shown in FIG. 9D. The closed state, after the snap hit, is shown in FIG. 9A. With the alternative of intermediate ribs, units one and two must perform analogously to the complete rib case.

In the same way that structures were allocated in unit two to spaces or masses of structures in unit one, ribs and channels of unit three must be allocated to spaces or masses of structures in unit one. The relation defined between units one and two specifies that flanges 31 would be aligned with the spaces defined by the clover's shape. A clover's shape defines three spaces and three mass structures joined in the center. There are three the possibilities that the clover's shape allows for compressing the system. In any of the three possibilities, flanges 31 and parts 34 will hook. Thus the clover's shape dictates the number and disposition of flanges 31 and parts 34. Three is the non-pair number that is present in the pattern to be followed. Three will be also the number of ribs to be present in the external part as a consequence of the original election of the clover's shape for the structures included in unit one.

The main point is that there are two levels of restrictions. The first restriction is dictated by the shape of the structures in unit one. The second restriction follows from applying the geometric sequence pattern. The consistency of the system requires that the interrelation of these three units of structures must be according to the shape of unit one and, specifically, to the geometric sequence considerations when allocating ribs and channels.

First, when the shape of unit one is decided, in this case a clover, three radial possibilities for assembling both parts exist. Hence, three flanges 31 will be conveniently disposed. Three of the parts 34 will be conveniently disposed as well.

Three ribs will be disposed as well according to spaces or masses of unit one. Three complementary channels can be present (one channel for each rib). Alternatively, six (two channels for each rib), or twelve (four channels for each rib) channels can be provided. The pattern to follow when allocating channels to ribs must consider the geometric sequence results, starting with the same number elected for the ribs. In this case, if three ribs result, then the number of channels can be three, six, twelve, twenty-four, etc. The geometric sequence specified requires that each following number should double the previous one.

For a first unit with a clover shape, there are three closing possibilities. There can be three flanges 31, three parts 34, three ribs 81, and finally three, six, twelve, twenty-four, etc., channels 51, taking into account the geometric sequence considerations. This situation can be observed from the figures.

The other two alternatives for the shape of structures present in unit one will now be analyzed. The previous analysis was for a clover shape. Three possibilities for compressing the parts of the system were dictated.

Figure 10C:
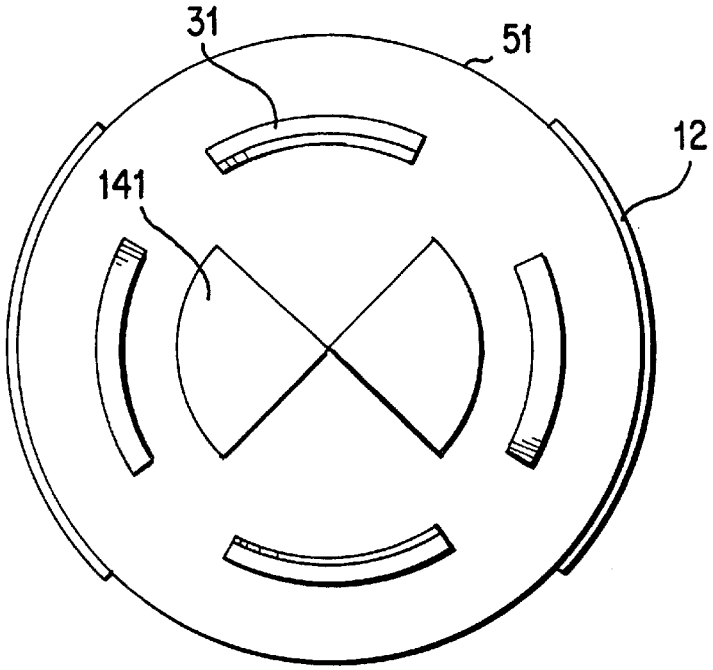
FIGS. 10C and 10D represent alternative shapes for the structures present in the center of the roof of the internal part and on the ceiling of the external part.

The first of the two other alternatives is a structure named twin triangles, in which two triangles confront at their vertex as shown in FIG. 10C. If this shape is used for structures included in unit one, then two radial possibilities for compressing the parts of the system will be allowed. Since there are two possibilities, three will be two flanges 31 and two parts 34. This structure will have flanges 31 aligned with access between mass in the twin triangles of the internal part. Parts 34 will be aligned with mass in the twin triangles of the external part.

There will also have to be at least two ribs and, if there are two, at least two channels. The geometric sequence considerations must always be kept in mind. If there are to be two ribs, then there can be two, four, eight, sixteen, thirty-two, etc., channels.

If four ribs are chosen, then there can be four, eight, sixteen, etc., channels. Channels will always comply with geometric sequence considerations and will always start at the number of ribs elected. One will never have a number of channels less than the number of ribs. Clearly, if four ribs and two channels are present, then two of the ribs have no path to go through.

The pair quality of fitting possibilities defined by the shape of the structures forming part of unit one dictates that ribs must be conceived in a pair number too. For example, there may be two ribs, four ribs, or eight ribs, always attending to geometric sequence considerations.

Figure 10D:
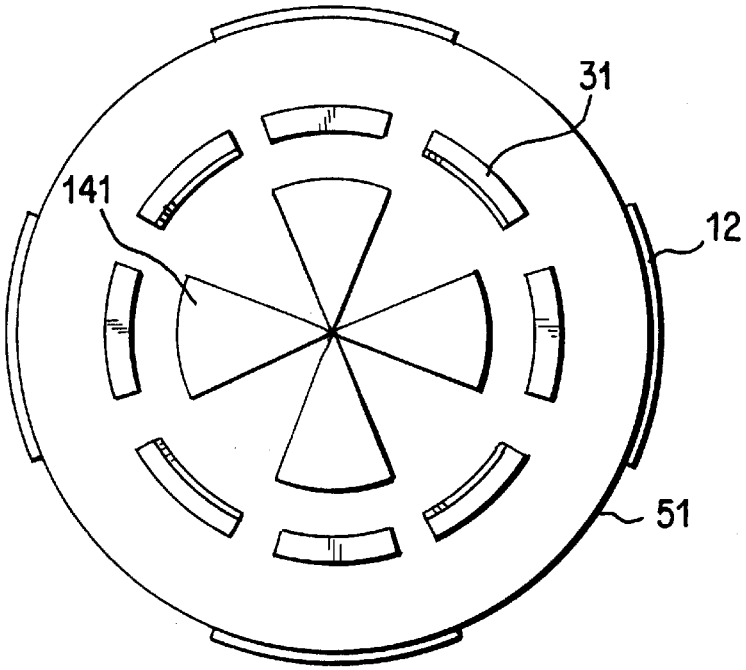

The second alternative structure has a shape which represents a cross. In this structure, four triangles are joined at their vertexes as shown in FIG. 10D. This allows the parts of the system to fit in any four radial possibilities. Hence, the quantity of flanges 31 will be four. Four will also be the quantity of parts 34. Flanges 31 will be aligned with spaces between the cross and parts 34 will be aligned with the mass of the cross present in the ceiling of the external part. Further, it follows that there will be at least four ribs (there also could be eight). The number of channels can start at four and may be four, eight, or sixteen, always complying with the geometric sequence considerations such that each number must double the prior one.

These three possibilities for the shape of the structure present in the first unit are patterns for assigning radial distances between the different objects involved in units two and three regarding structure in unit one.

Regarding the convenient radial distances assigned to objects in units two and three, the number of structures (flanges 31 or ribs 81) can be smaller than advised when the spaces between the rest of the structures (the rest of the flanges 31 or the rest of the ribs 81) is maintained.

Figure 5A:
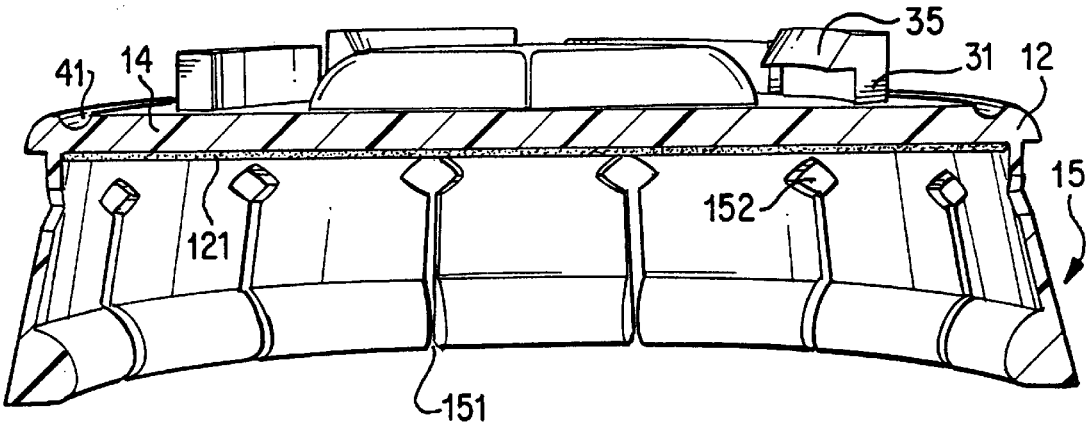
FIG. 5A is a sectional view of the internal part showing the proposed alternative radially outwardly and downwardly extending skirt design.
Figure 5B:
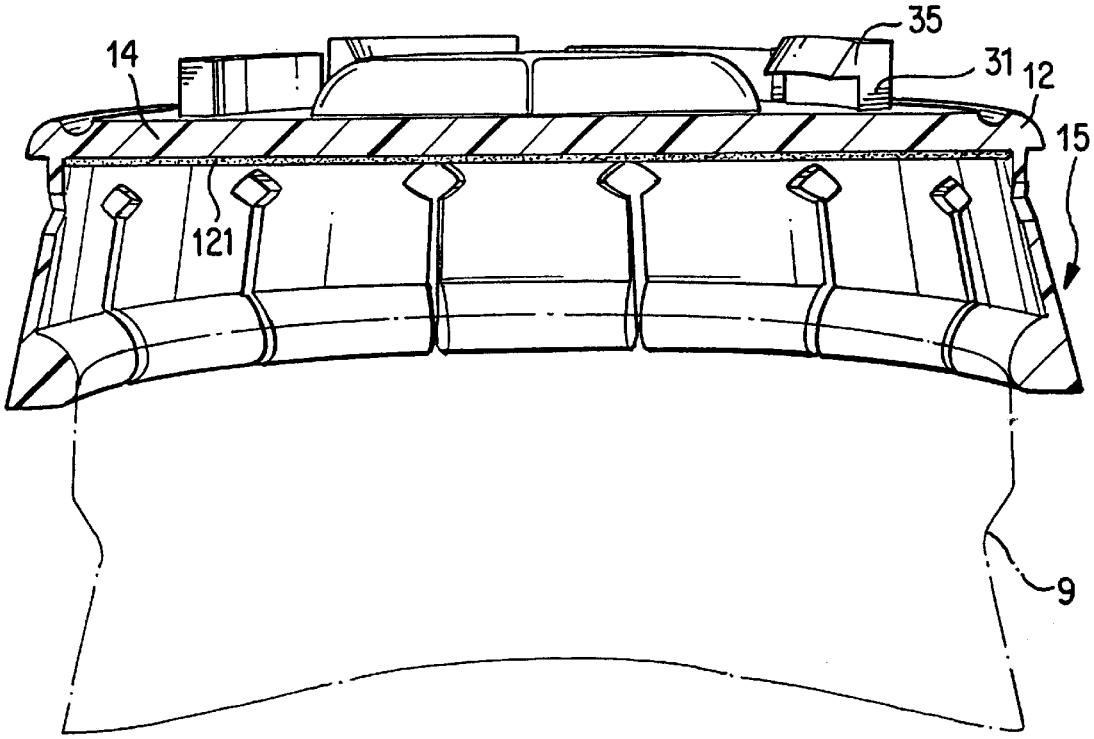
FIGS. 5B–5E are various illustrations of the same internal part, in sectional and complete views, showing cooperation between a bottle and the internal part.
Figure 5C:
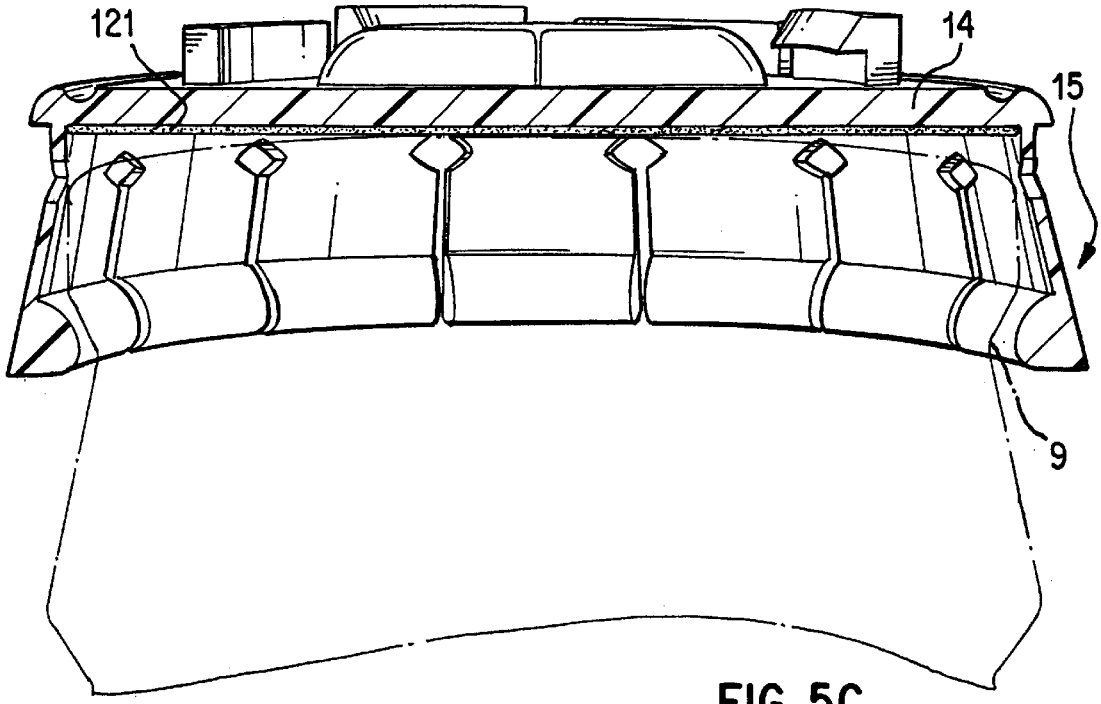
Figure 5D:
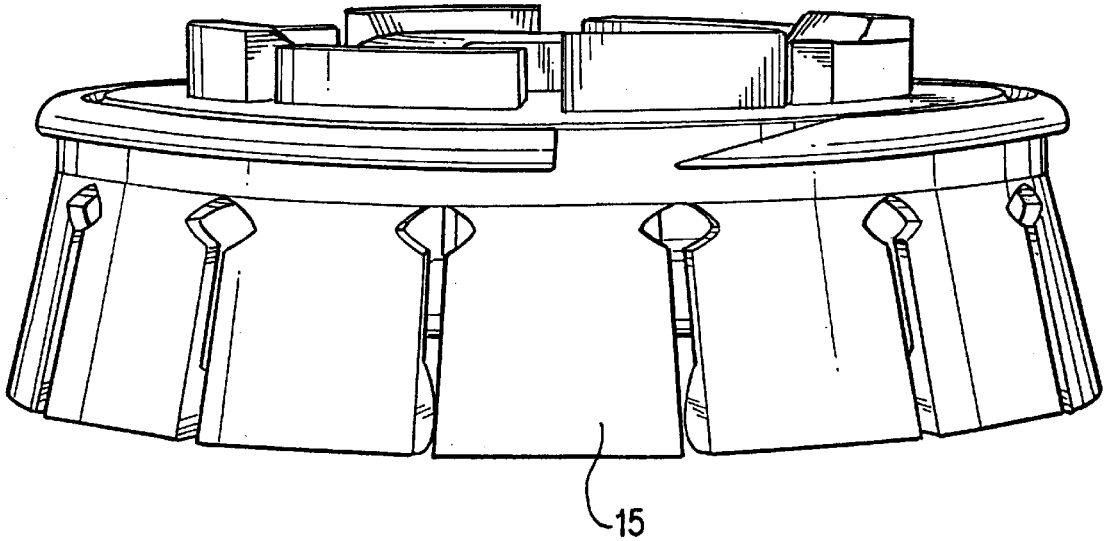
Figure 5E:
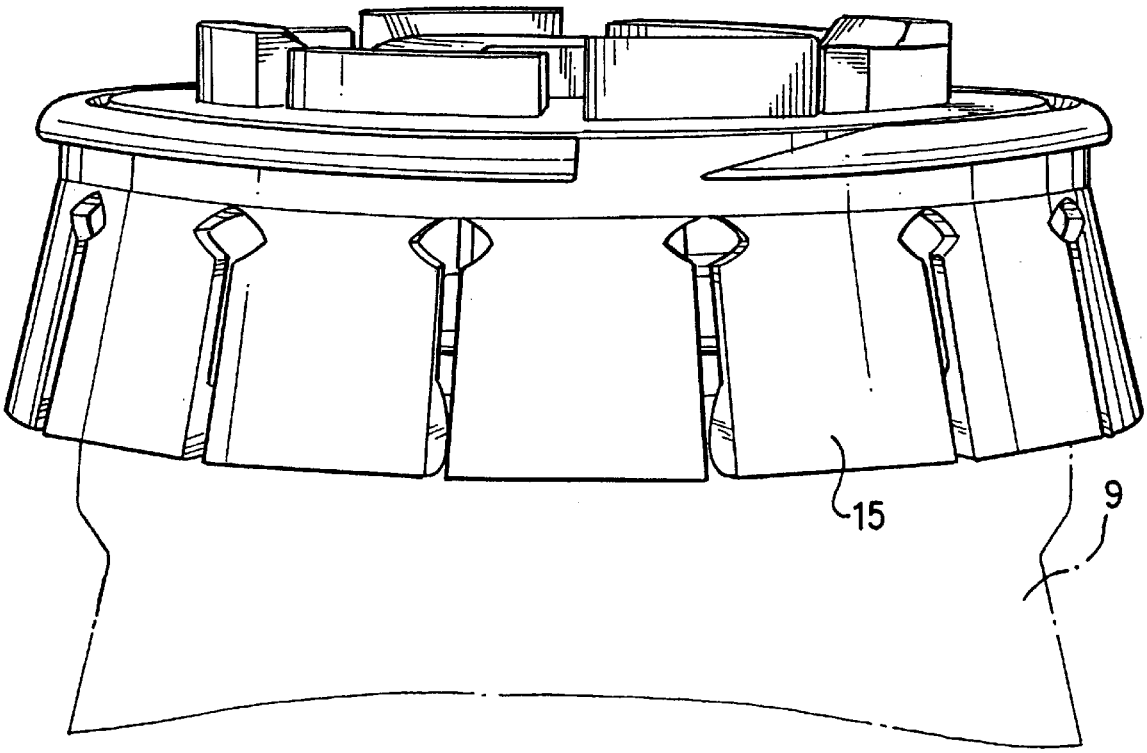

FIGS. 4A and 5A show the top parts of ducts 151. The top part of each duct 151 defines an ellipse 152 which will maximize the venting process performed during the opening operation. When, during the mentioned releasing operation, the internal liner 121 is at least partially removed from tightly contacting the extreme of the bottle, pressurized carbonation will be freed through these ellipses 152 all around the closure. The mentioned pressure is quickly evacuated at the same time vertically downwardly through the ducts 151 until the danger of popped-off closures is eliminated. As previously mentioned, when internal liner 121 is slightly removed and venting takes place, binding ring 11 on external part 1, will still bind the skirt 15 on internal part 2 in such a way that the skirt 15 will not be able to expand or outwardly radially flex to allow the closure to be released from the extreme groove 9 of the bottle.

The ellipses 152 allow the assembling machinery to effectively position both parts of the system for assembly into the mounted position, considering the dispositions of structures in units one and two. A distinctive device in some of the ellipses can be aligned to the spaces defined by the shape of unit one in the roof of the internal part. A complementary distinctive device in the external wall of the external part can be aligned with the mass belonging to the complementary structures. Optimum positioning, therefore, can be done. This situation is shown in FIG. 10A. This is the case of identification pattern 150, which depending on the pattern dictated in the structures of the ceiling of internal part, will allow the machinery to position both parts of the closure in a proper confrontation to be assembled.

Related to the mathematical formula that will effectively determine the convenient quantity of channels needed, according to the chosen quantity of ribs, the geometric sequence will dictate this information in the following way.

The general formula for the geometric sequence is denoted as:

$$R^{n-1}\times A$$

This pattern allocates the channels in relation to respective ribs. One example of this allocation is to define two (2) ribs that are supposed to find their paths through two (2), four (4), eight (8) or sixteen (16) channels distributed around the lifting ring. It is always convenient to assign possibilities for the disposition of these complementary structures so that the number of channels is in a multiple of the number of ribs, for example, two (2), four (4), eight (8), sixteen (16), etc., when the decided number of ribs is to be two (2). If the decided number of Ribs is to be three (3), then the number of channels must be three (3), six (6), twelve (12), twenty-four (24), and so on.

In the formula described above, the letter R represents the ratio over which the number of channels will grow. R, for example, may be two (2) or three (3). The letter n represents the step of the alternative that is to be chosen once the formula is displayed. If the case of two (2), four (4), eight (8) or sixteen (16). Here, alternative eight (8) would mean that n equals turn 3. Finally, A represents the number of ribs chosen, after which the ratio of growth of channels will be dictated. If the number of ribs is two (2), then alternative numbers of channels will duplicate the previous one. If there are three (3) ribs, then alternative numbers of channels will triple the previous number.

If, for example, one chooses to use two (2) ribs, then since two (2) ribs have been chosen, possibilities for a number of channels will have to duplicate each other, so R will be two as well. A (Ribs) was chosen to be two (2). n will be one (1), two (2), three (3), four (4), as the steps of the formula evolve.

Main formula:

$$R^{n-1}\times A$$

In the first step:

$$2^{1-1}\times 2=2^{0}\times 2$$

Any number powered to zero equals to one, so we have: $1\times 2=2$. Two will be the first step in our chain of possibilities.

In the second step, when n is equal to two (2), we will have: $2^{2-1}\times 2=2^{1}\times 2=2\times 2=4$. Four will be the second step in our chain of possibilities.

In the third step, when n is equal to three (3), we will have: $2^{1-1}\times 2=2^{2}\times 2=4\times 2=8$. Eight will be the third step in our chain of possibilities.

In the fourth step, when n equals to four (4), we will have: $2^{4-1}\times 2=2^{3}\times 2=8\times 2=16$. Sixteen will be the fourth step in our chain of possibilities.

Results following from this exercise show that they duplicate the previous answer. This pattern is chosen to rule disposition of relative quantities of ribs and channels. The number of ribs forms the INPUT in this formula and the possible number of channels to choose forms the OUTPUT or final result.

2: 2,4,8,16, . . .

INPUT=2

OUTPUT=2, 4, 8,16, . . .

As can be observed, results from applying this geometric sequence formula to a defined number of ribs will dictate possibilities of convenient numbers of channels to be assigned to the lifting ring during the production process.

When the ribs are not to be already positioned over the channels and the upper extreme does not reach the ceiling of the external part, as the quantity of channels elected gets bigger, the twist of the external part gets shorter during the opening process. In an analogous way, as the quantity of channels elected gets smaller, the twist of the external part gets bigger during the opening process. By the joined action of twisting and pulling, the upper extreme of the ribs will search for their path through the channels. The more channels there are, the faster the ribs will find their path. Conversely, the fewer channels there are, the longer it takes for the ribs to find their path. This allows certain systems to perform more quickly than others.

The number of ribs chosen (e.g., two (2) or three (3)), is related to the shape of the complementary structure described as being present in the roof of the internal part 2 and in the ceiling of the external part 1. In this preferred embodiment elements 141 and 142 are defined as clovers. If three (3) ribs are chosen, then the clover shape is correct, since it provides three (3) possibilities for clamping with its complementary structure. If the number of ribs chosen is two (2), then the convenient shape for this complementary structure will be two confronting triangles or, more precisely, sectors, since this shape provides two possibilities for clamping. The chosen number of channels, according to the possibilities that the geometric sequence provides, will be equal to or bigger than the number of possibilities of clamping that the shape of the complementary structures of unit one on top and ceiling of both parts can offer. Hence, if the shape of such structure is like a cross, with four (4) triangles joined in the center, then the number of channels chosen from the results of the geometric sequence would have to be four (4), or eight (8), or sixteen (16), etc.

Another modification will now be described with reference to FIGS. 11–13. In any kind of bottle, hermetic qualities are mainly obtained by a vertical force downwardly applied by the cap towards the liner and hence over the edge of the bottle's mouth. For assuring hermetic qualities, a level of precision between the parts interacting in sealing is substantial. This issue is a major concern in bottling industries. Regarding the precision of the different objects present in the sealing interaction, variations on measures in the same type of containers due to different reasons is present, particularly in returnable glass type bottles. These, when washed in the bottling process, suffer an erosion which provokes changes in measures of the extreme of the neck of the bottle, just where the closure will be positioned. Differences due to the ages of the bottles between each other, and to the different providers of such bottles, are observed as well. In order to assure hermetic standards, these differences have to be compensated for and neutralized by the equalizing capabilities of the capping system implemented therefor. Through elasticity, an equalizer capacity provides the compensation for such possible differences.

The elasticity of the plastic forming the parts of the system is a quality that, applied by the shape of the internal part, produces as a result the effect here named "equalizer" for its equalizing qualities over the differences or variations that the part of the bottle where the cap will be positioned might have. The equalizer effect is achieved as a result of the flexible quality of the material conforming to the part, plus the shape given to that part. This effect will assure that, despite the existence of the mentioned variations of the shape of the extreme of the container, which are commonly expressed as a critical tolerance, the hermetic capabilities that the capping system must achieve will be reached in each bottle as a result of the adaptation performance that the "equalizer effect" generates.

The equalizer effect, which is the result of the joining of the flexible property of the material and the shape of the internal part of this system, is significant.

The mentioned shape of the internal part will provoke the flexible quality, and eventual elongation, of the material to create a force that will be applied to achieve hermetic standards. The quality following from this shape is specifically generated around the point where the "main plate" 5 (or horizontal plane) of the internal part turns into the skirt 20 (or vertical plane) of the same part.

According to what is described in the previous applications of this invention, this specific transition area 90 is represented as a right angle (90 degrees). In order to maximize the possibilities of the "equalizer effect" by creating a variation range for the intensity of such effect, the transition area 90 in where the effect is generated, can be defined as one or more than one solely angle of 90 degrees. This possibility understands the transition area 90 as a continuity of angles to make such transition more smooth and round looking. The groove 80 positioned in the ceiling of the internal part will help in the flexing operation of the annular area outwardly placed from the groove 80, turning it to an oblique pattern to let the stripes 22 be downwardly pulled as a result of the compressing operation. The different possibilities of shapes for the Internal Part described herein, guide and assign the forces and tensions resultant from the flexible quality of the material, towards achieving an specific effect, the "equalizer effect". Tensions and forces object of this effect, can be managed with a bigger range and tolerance. The wider of the range of tolerance that we are able to handle in the adapting quality of the effect, bigger will be the variation range that the system will be able to contain when applied to the tolerance observed in the variations of the bottles.

Figure 11:
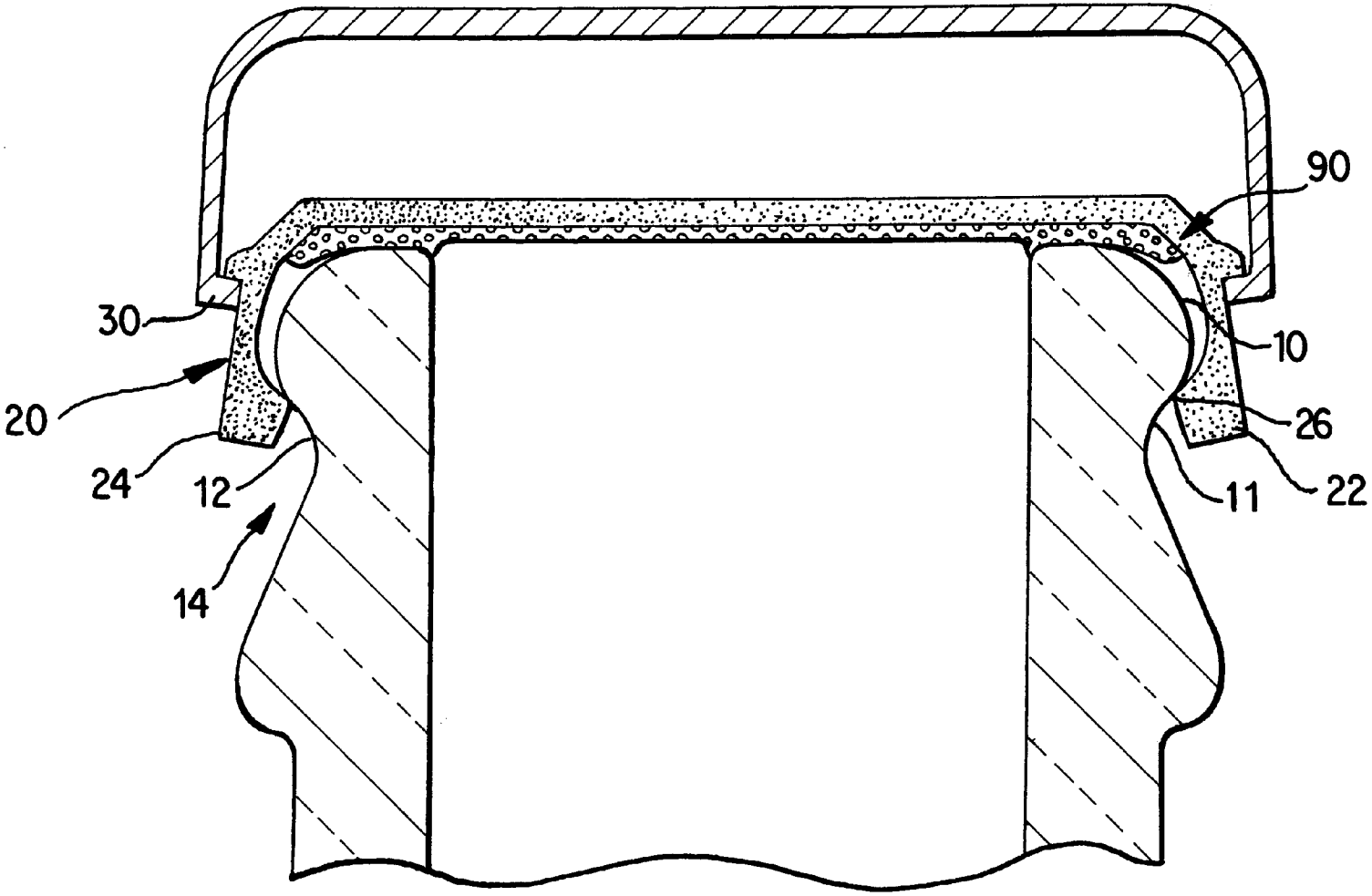
FIGS. 11–13 illustrate an alternative cap construction utilizing deformation of the internal part to produce hermetic sealing.

When the cap is positioned as shown in FIG. 11 by the bottling machinery over the neck of the bottle, in the internal part of the system, the transition area 90 has a 2 mm×2 mm (0.0787 inches×0.0787 inches) area which is not in contact with the bottle. It can be identified for not copying the oblique contour 10 of the neck of the bottle. This fact provides to such area the possibility of flexing towards copying the bottle's shape, when being downwardly pulled by the short stripes 22 belonging to the skirt 20. As proposed here, the length of the stripe 22 should not be reaching the critical point 12 of the bottle groove 14 without a special pulling force. During the compression process of the system, these stripes 22 will be displaced by an overlapping force applied in their external side 24 by the binding ring 30, so to make them downwardly slide along the slope 11 defined by the groove 14 of the bottle until reaching an optimal fit over such groove. The pressure that the binding ring 30 asserts over the external extreme 24 of the stripes 22, when being downwardly slid, makes the internal shape of such extremes, known as vertex 26, interact with the slope 11 of the groove 14 of the bottle. That interaction makes the extreme 24 of the stripes 22 to fit in the groove 14. This displacement, which means a temporary modification of the part's shape, is possible due the mentioned flexing capabilities of the angles in the transition area 90, which are part of the arch effect quality.

Figure 12:
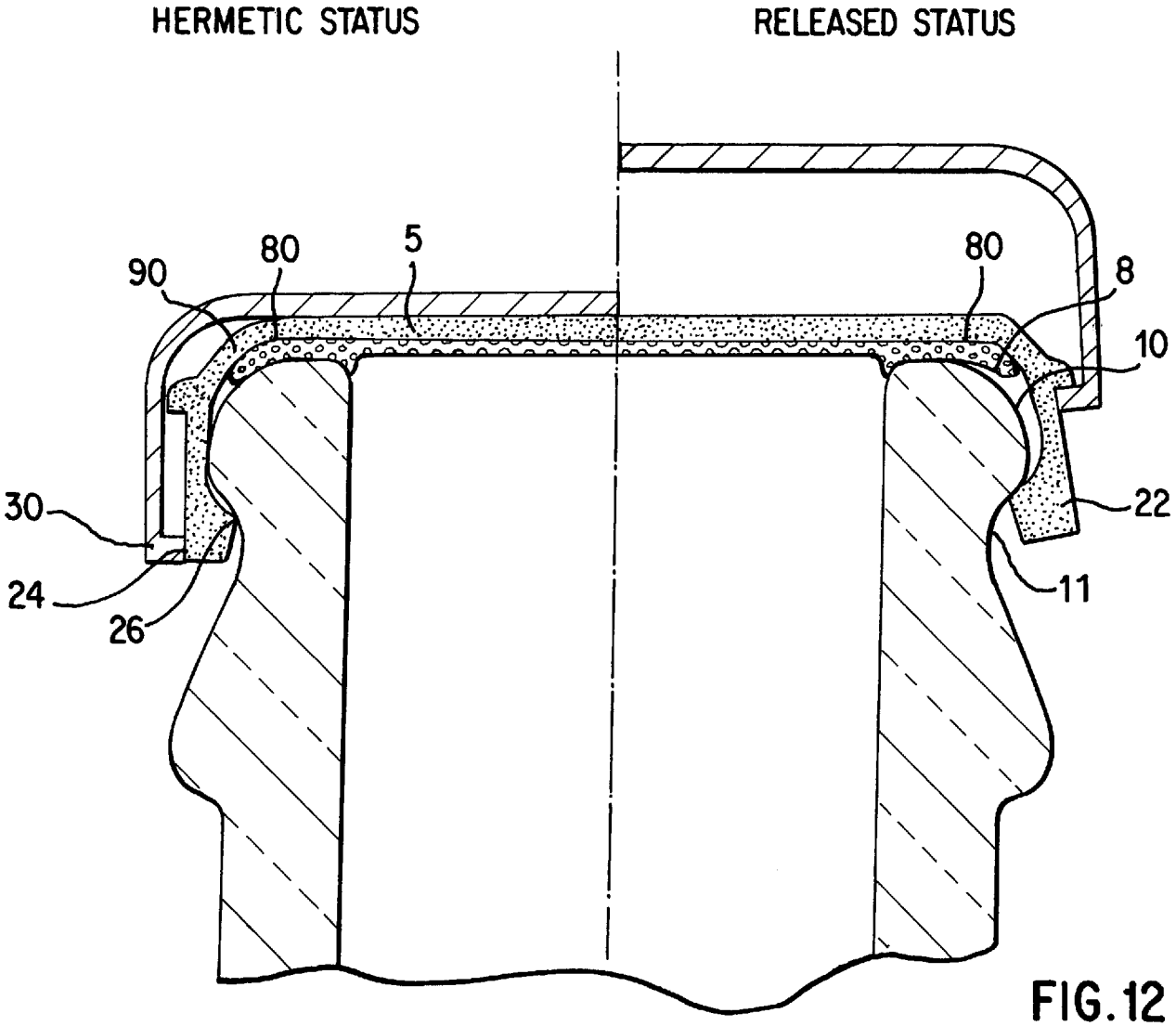

In FIG. 12 the layout shows the same cap in two different moments. At left, the hermetic status shows the binding ring 30 surrounding the extreme 24 of the stripes 22. It can be seen how the stripes 22 were induced to a tighten and secured status. As the binding ring 30 slides down, the vertex 26 slides along the slope 11 from the status observed on the right hand to the one observed on the left hand. The liner 8 has also been influenced to better grip the shape of the bottle. Groove 80 serves as turning point to allow the main plate 5 to become part of the gripping action when tension is applied over the transition area 90. During the arch effect, while the system is in closed status, the mentioned transition area 90 suffers a temporary deformation towards the contour 10 of the shape. Groove 80 helps the part to flex in order to efficiently gripping the shape of the bottle. Liner 8 is modified as well by the flexing action of the main plate 5. In that situation, hermetic capabilities of the system are maximized while neutralizing possible variations of the bottle's neck shape that could threaten hermetic standards. During the closed status, the system remains in a potential reaction force to return to it's original form, when the pressure of the external part over the internal one is released. The equalizer capability is obtained by the arch effect. It is named arch effect because it is obtained from the radial sum of the arches defined from each stripe 22 to the opposite stripe 22 and the union of these two in the main plate 5.

Figure 13:
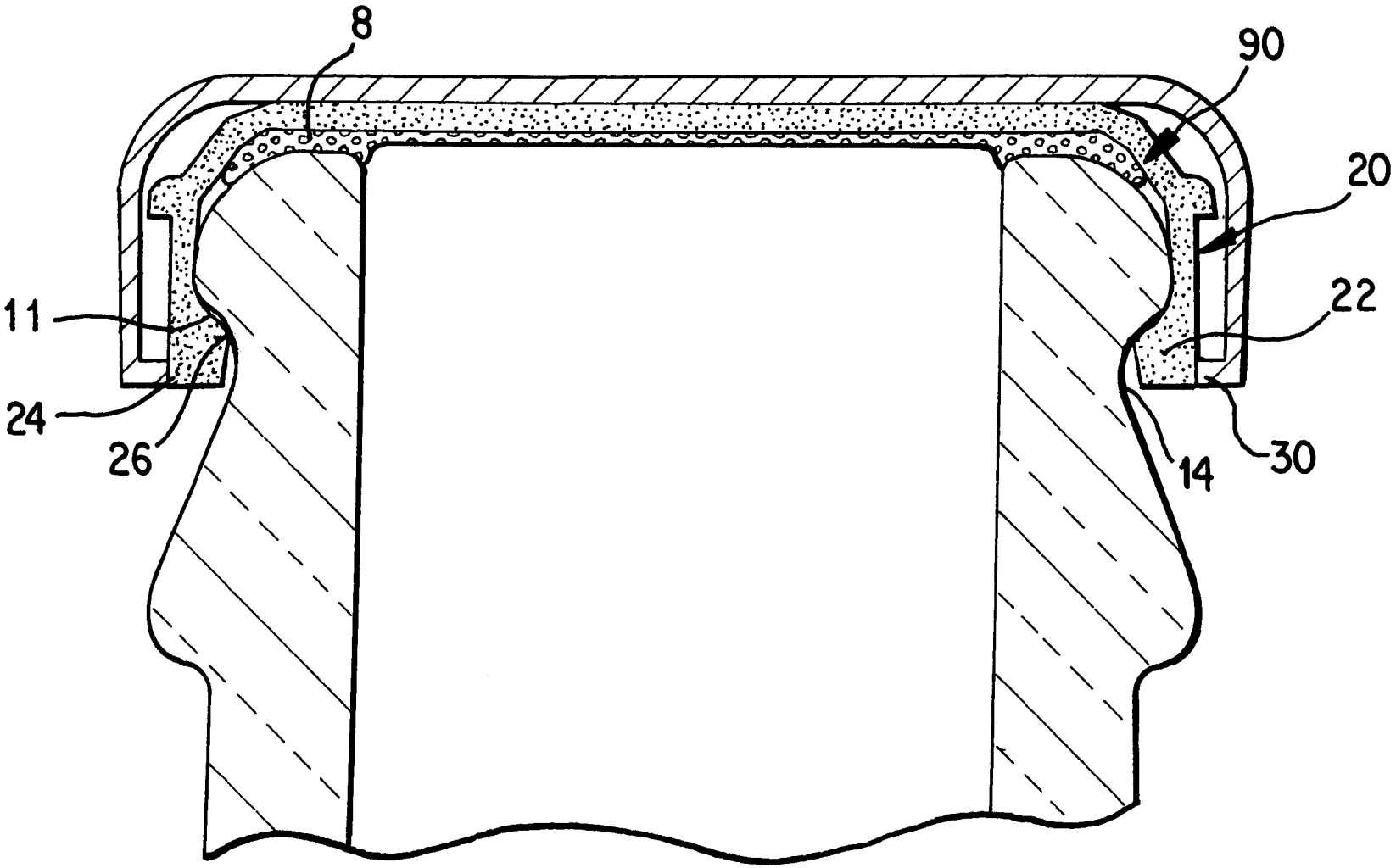

When the system is in closed status and the "equalizer effect" is active as shown in FIG. 13, the extremes of the stripes 22 conforming the "skirt" 20 are fitted over the groove 14 of the neck of the bottle. Such stripes 22 were forced to reach that point by the external pressure of the "binding ring" 30 of External Part. The "liner" 8 present in the ceiling of the Internal Part is snugly fitted towards the border of the extreme of the bottle, assuring hermetic standards.

The vertex 26 works sliding like a wedge/quoin over the oblique plane of the slope 11 in groove 14 as the binding ring 30 is downwardly sled. This effect makes the stripes 22 to be pulled down provoking the tension in the transition area 90. The tolerance of that tension will be according to the surface that the vertex 26 finds in its path. If a highly eroded surface is found, deeper the vertex 26 will go, and tighter the tension in the transition area 90 will be. If a standard surface is found, the vertex 26 will perform without equalizing erosions, and the tension observed in the transition area 90 will be the expected one to a standard bottle. Certainly, the tension assigned to the system to work in standard bottles, will be enough to assure hermetic standards. The surplus tension observed in eroded bottles, will equalize the differences in the bottles shape, assuring hermetic standards as well.

If the tolerance of the shapes of the bottles varies, for example in 0.6 mm/0.0236 inches, a tension tolerance of 0.8 mm/0.0315 inches will be assigned to the transition area 90. Since the tolerance of the equalizer effect is wider than the tolerance of the shapes to be equalized, the system will assure that, either with high tension or with standard tension, hermetic standards will be reached as a result of the equalizer effect. As previously mentioned, the standard tension already assures hermetic standards for standard bottles. In standard bottles, vertex 26 won't grip as deep in groove 14 as in the case of eroded bottles. Hermetic quality will be achieved by the solely fact that stripes 22 will anyway be pulled down in the compression operation. If extremes of the stripes 22 don't grip deeply, Binding ring 30 has absorbing capabilities to bind the skirt 20 anyway. The surplus of tension will be applied according to the kind of surface that the vertex 26 finds in its path on the groove 14. The surplus tension resulting from each case, will have a direct correlation with the level of erosion found. In all cases, the resulting tension will provide an analogous hermetic status to the one found in standards cases. Transition area 90 and binding ring 30 have capability to elongate and support (or provide) tension. Stripes 22 themselves have as well, capability to elongate. In either case of an eroded bottle, the functionality of the system will grip the neck of the bottle to assure hermetic standards.

Erosion of the bottles are mostly observed either in the top of the neck or/and the groove 14. In either case, the tensions generated by the external part compressing over the Internal one, will seal the bottle. The existence of a liner in the ceiling of the Internal Part is substantial to the sealing performance once the equalizer effect is generated. The first variable (the erosion found), dictates to the system the needed performance for the second variable (the needed tension), to make the hermetic standards to prevail.

When the closure is in compressed status, binding ring 30 will have been downwardly sled surrounding external extremes 24 of stripes 22. As vertex 26 becomes externally pressed, it will slide along the slope 11 of groove 14, until the external part is completely compressed over Internal one. According to the shape of the groove 14, vertex 26 will generate different degrees of tension to transition area 90. The more erosion the groove 14 has, the more degree of tension will be generated. In the case of a bottle which groove 14 is in standard status, standard tension will assure hermetic standards, and elongation qualities of the binding ring 30 will absorb what the groove 14 did not, and should have in the case of an eroded groove.

One of the features associated with this equalizer effect is the fact that the length of the stripes 22 is not longer enough to reach the critical point 12 in groove 14 by itself. Stripes 22 are shorter and must be pulled down as the binding ring 30 compresses the skirt 20. The term "pulled down" means that, as a result of the pressure applied by the binding ring 30, vertex 26 will downwardly slide along slope 11 of groove 14. This will provoke the reaction of a force or tension observed in the transition area 90. This tension is the quality assuring hermetic standards. The tolerance that the tension provoked in transition area 90, is the quality that allows the system to be hermetic in bottles which tolerance of erosion is lower than the tolerance of the transition area 90.

As can be observed in FIG. 13, binding ring 30 applies pressure over the external extreme 24 of the stripes 22. A critical fact is that binding ring 30 applies its pressure below the horizontal level of vertex 26. If we draw an outwardly horizontal line from the vertex 26, binding ring 30, will be positioned below that line. This makes the stripes 22 to maximize their griping performance on the groove 14.

Due to the gripping nature of the internal part to the extreme of the bottle, such internal part will be fixed on its place without moving nor rotating. The gripping disposition of the internal part performs in an axial way, gripping with the main plate 5 from the top, and with the vertex 26 from the bottom. The vertex 26 will be applying an upwardly force towards the oblique plane 11 of the groove 14, when binding ring 30 surrounds it. This situation will be held until the "binding ring" 30 is upwardly sled to release surrounding force towards the extreme of the stripes 22. During the opening operation, which includes a twist of the external part, the internal part will remain in place without rotating.

Figure 15:
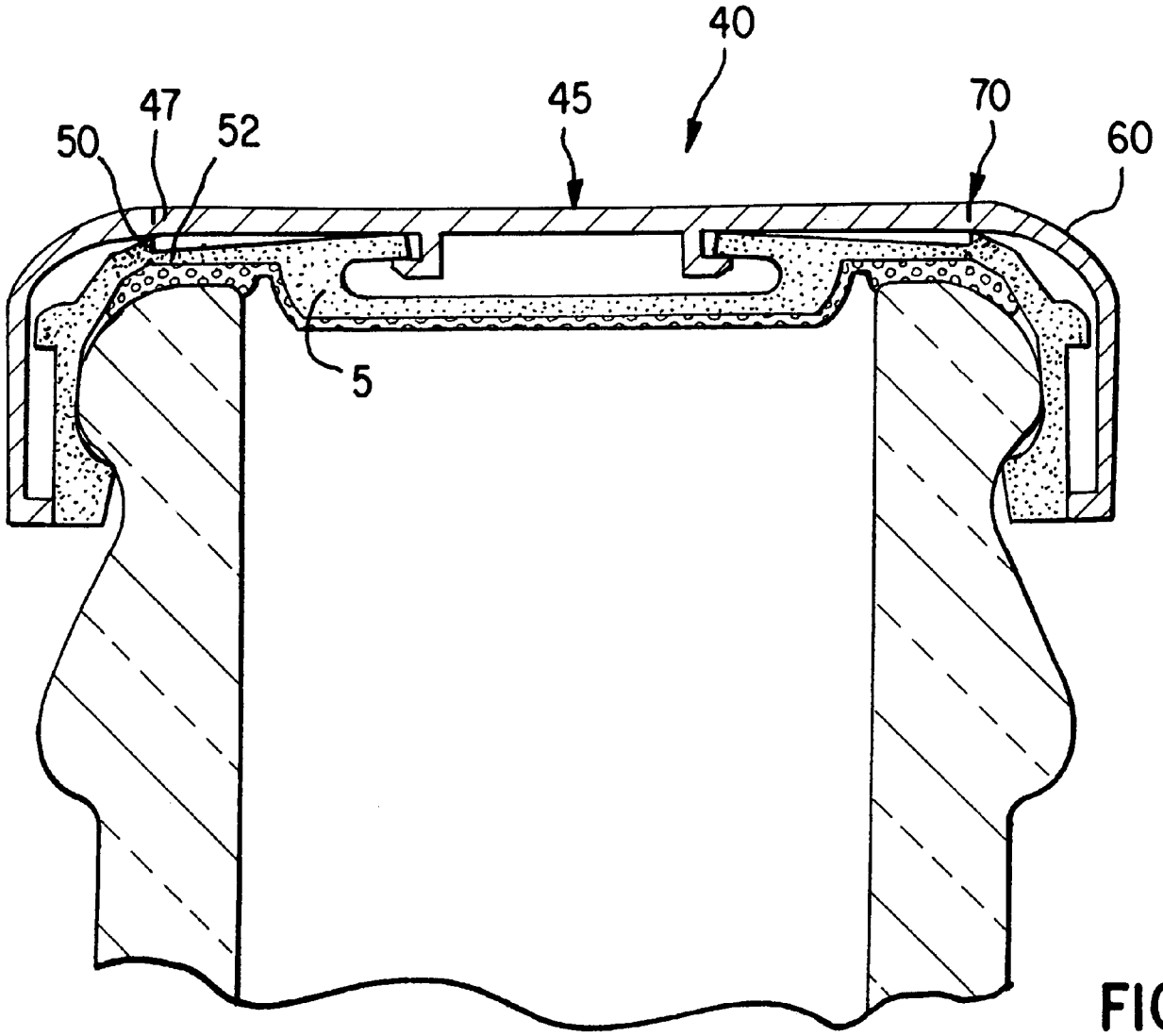
Figure 16:
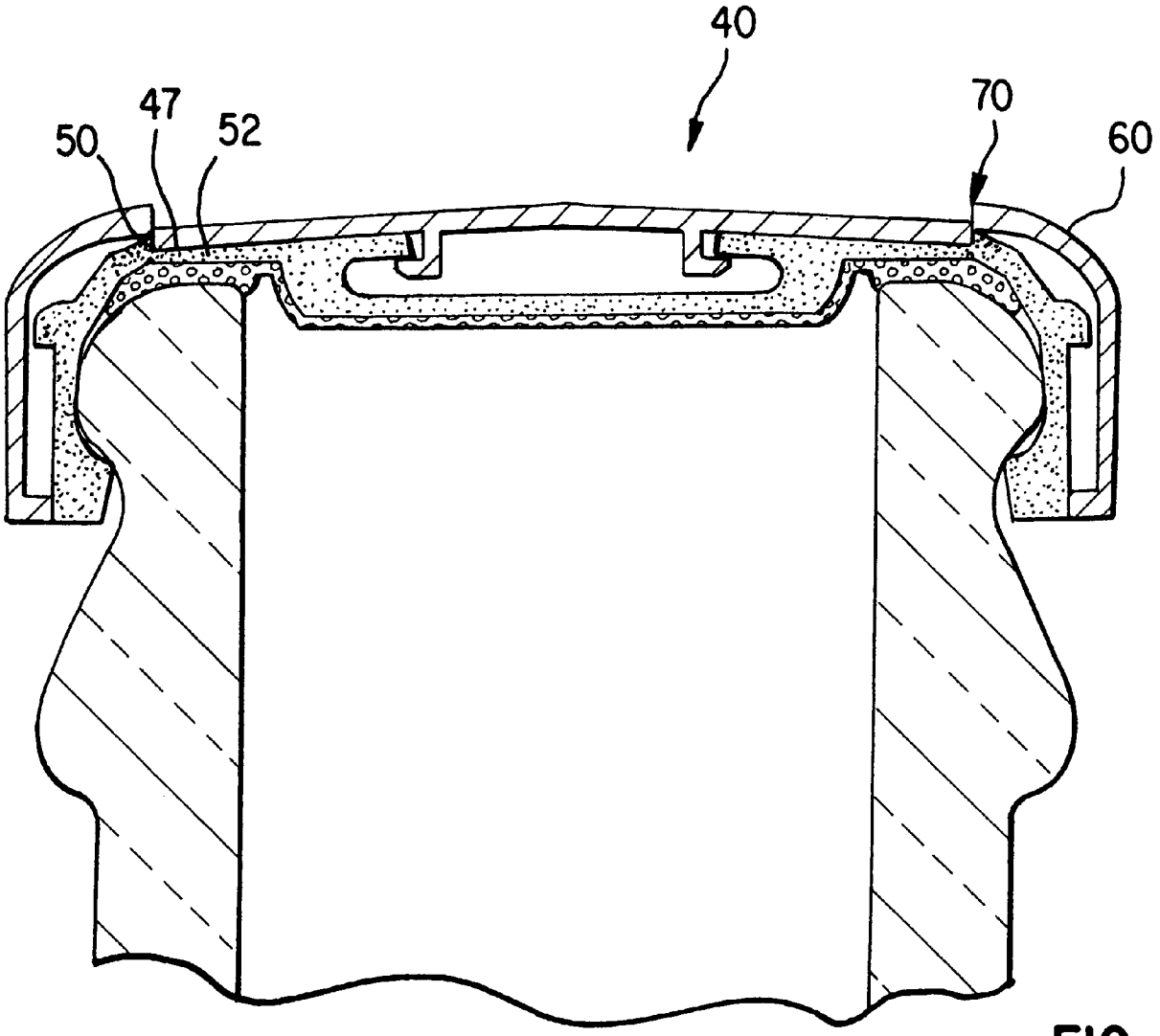

Yet another modification will now be described with reference to FIGS. 14–16. In the external and internal parts, the main 5 plate, the breach line 70 and the interlocking parts as shown in the drawings, have in this embodiment two special dispositions. The first of these is a difference of levels. The exterior annular area 60 of the external part delimited by the breach line 70, has its base in contact with the point 50 of the internal part when the cap is compressed but before an interlocking was done. This external annular area 60 is taller than the central circular area 40 in the other side of the breach line 70. The interlocking structures of both parts have not interlocked yet. The second special disposition is that shape of the roof of the external part is convex molded. In order to make both parts interlock, it has been preestablished, by the effect of the convex molding of the external part, that an applied force is needed to downwardly flex the center 45 of the circular area 40 of the external part. The center of the inner face of the circular area 40 will hook with the opposite area in Internal Part. The perimeter 47 of such a central area 40 remains in soft tension, not in contact with the internal part as a result of the difference of levels previously mentioned and the fact that the breach line 70 has not yet been detached. This perimetrical area 47 of the central circle 40 does not touch the internal part before the break of the Breach Line 70.

The perimetrical area 47 of the central circle 40 will not be in contact with the roof of the internal part since it will be sustained by the bars (similar to the segments 92 in FIG. 10B) of the breach line 70. In this situation, the area will remain stable and with soft tension, until recovering its original form, which will be possible only after the break of the bars in the breach line 70. When the break happens, this perimetrical area 47 of the central circle 40 will downwardly flex in response to its original convex molding conformation until entirely touching the roof 52 of the internal part of the system.

In this situation, with the cap in closed position but with the breach line 70 broken, there will be evident a difference of levels in the opposite sides around the broken breach line 70.

Figure 14:
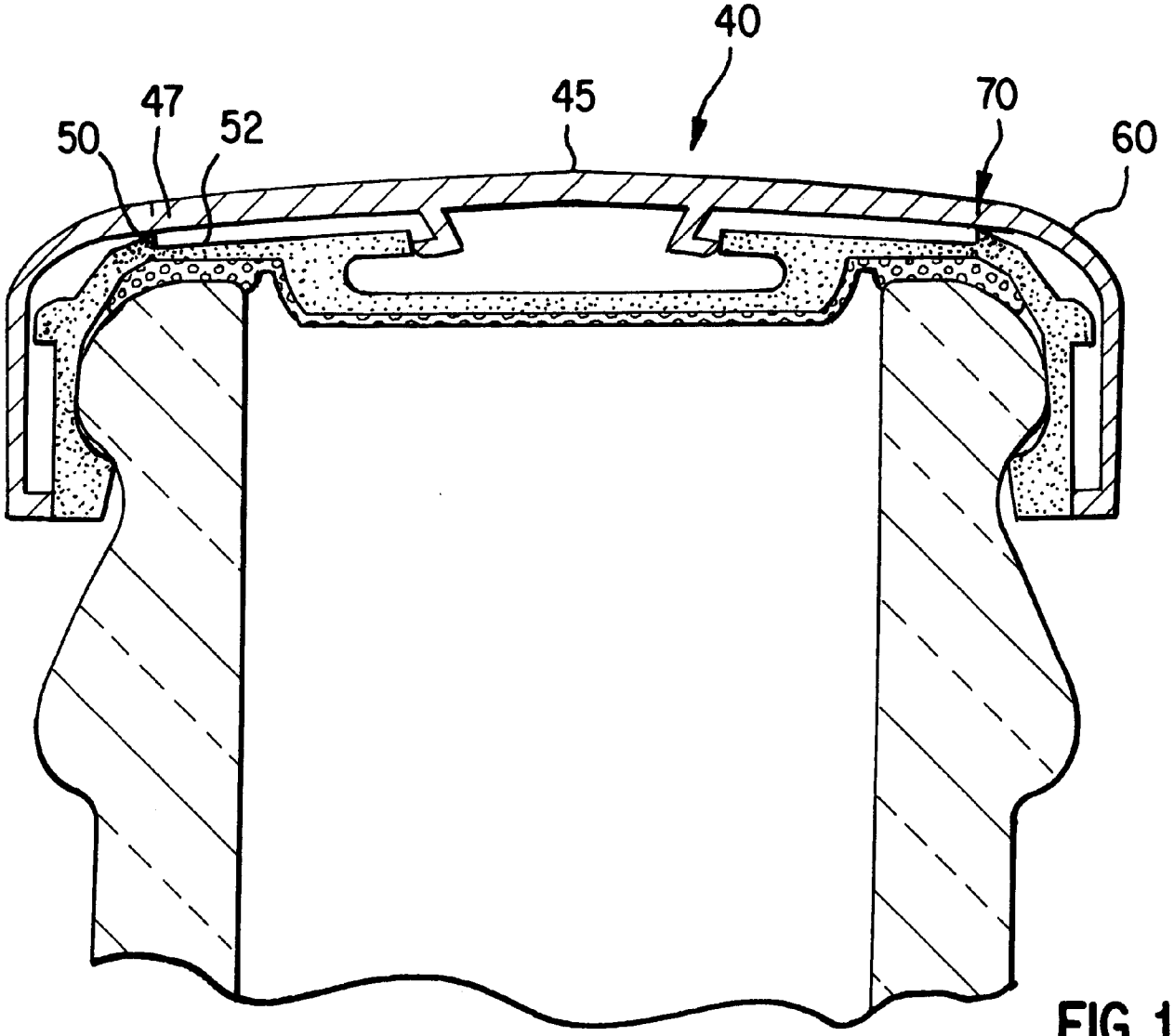
FIGS. 14–16 show a modified tamper evidence producing construction.

FIG. 14 shows the closure compressed but still not interlocked between the parts. A hit at point 45 is necessary to interlock both parts. FIG. 15 shows the closure interlocked after the bottling machinery applied the hit in point 45. This is how the consumer will receive the product. After tampering with the breach line 70 and consuming part of the product, the consumer may want to re-cap the closure over the bottle. When the re-capping operation is done, and the external part is compressed over the internal part, the difference in levels provide evidence of the previous tampering of the closure. FIG. 16 shows this state.

Figure 17:
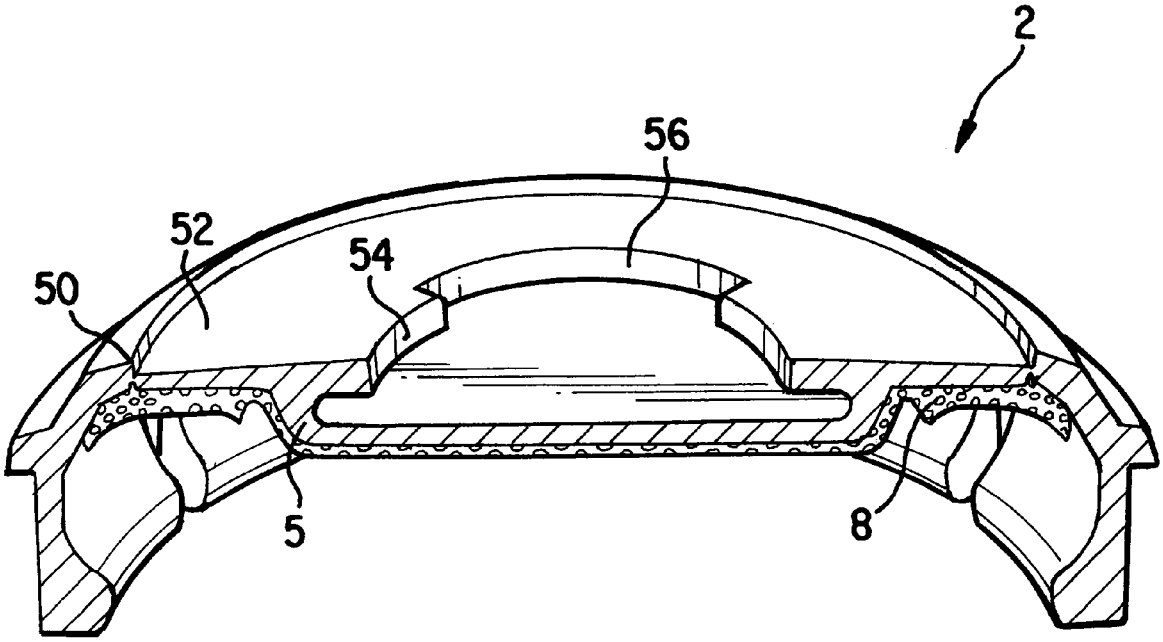
FIG. 17 shows a modified internal part structure.

In FIG. 17, internal part 2 is shown in a perspective view. This view illustrates the conformation of the main plate 5, roof 52, flanges 54 and spaces 56. Liner 8 and point 50 are also evident. It can be seen from this figure how flanges 54 will allow hooks, belonging to the external part, to interlock while spaces 56 will avoid any possibility of rotation of the central circle 40 of the external part over the internal part. A special structure belonging to the external part will be positioned in a complementary way in spaces 56 while hooks belonging to the external part will lock with flanges 54. The central circle 40 of the external part will not be able to rotate; complementary structure placed in spaces 56 will be laterally contained by flanges 54. Rotation of the central circle 40 is avoided to allow the breach line 70 to break during the twisting action of external annular area 60 of the external part. This disposition of flanges 54 and spaces 56 allows the system to unify its interlocking tools with its anti-rotational tools in one single structure. In other embodiments, hooking tools were independent from the anti-rotational tools, and were differentiated regarding their position, for example, with different diameters. In this embodiment, the flange 54 serves as a hooking tool and as a parameter for anti-rotational structure. This embodiment simplifies the design of the part and the mold needed to produce it.

Before the system is bottled during the shipment to the bottling plant, it is intended to minimize the probability of the system interlocking itself by accident during the shipment from the production plant to the bottling plant. If this happens before the system is positioned over the container, then the cap would become useless.

With the new design described above, the key factor to turn the system into an interlocked status, is a specific hit in the center point of the central circular area. This hit makes the structure flex and hook to the internal part. If the caps are shipped in a compressed status, the annular area would be positioned over the roof of the internal part and the hit that would activate the interlocked status would become quite specific. Such specificity can be applied by bottling machinery but hardly by chance. This specificity is the factor that minimizes the risk of ruining the system by accident before the bottling process takes place. Shipping the caps in a compressed status but obviously without the parts being interlocked might be an acceptable way of minimizing risks of ruinous systems before the caps are applied.

After the system was bottled during the distribution process, the caps have already been applied over the bottles and the interlocking status was obviously activated. The convenient difference of levels between the areas of the external part is estimated in approximately 0.6 mm (0.0236 inches).

Since the bars to be detached in the breach line during the upward sliding of the external part need 1 mm (0.0394 inches) to be broken, an aleatory downward hit over the external part will not provoke an accidental broke of the breach line that could ruin the integrity of the system. If an accidental hit over the external face of the central circular area is done, then nothing critical happens. A similar scenario is observed if the hit is performed over the annular area of the part. The roof of the internal part supports both areas of the external part. The only way to break the breach line is by a twisting action of the annular area around the central one, or by upwardly sliding the annular area. Neither of these operations happen in an aleatory way. The probability of an accidental break of the breach line during the chain of processes until the product gets to the outlay stage is minimized.

Another advantage of this embodiment compared to those previously proposed in the previous patent application is that the annular area does not need to surpass the edge of the border of the central area if the consumer wants to release the closure after having it re-capped. No friction between edges of the detached breach line will occur when releasing the closure for a second time. Another advantage is that there cannot be any situation that could neutralize the effect of the tamper evidence after the closure is released by positioning both the annular area and the central area at the same level as if the closure were not tampered with. Further, the bay structure of the internal part shown in FIGS. 14, 15 and 16 allows the system to minimize its height of the closure above the top level of the container in order to improve the aesthetic aspects sought in the industry. This embodiment diminishes the quantity of raw material needed to produce the closure. Special means, similar to those previously presented to fix the central area of the external part to the central area of the internal part during the compressed status, are provided to prevent the mentioned central area of the external part from undergoing rotational movement during the twisting action to release the closure.

An alternative to the above described embodiment makes the annular area the one operating to make evident the difference of levels instead of the perimeter of the central circle. The tension to be released after the break of the Breach Line to allow the structure to recover its original conformation will be located in the annular area of the Part, not in the perimeter of the central circular area.

In the previously described process, the perimetrical area of the central circle is the one operating to make evident the difference of levels when the breach line is detached. In the following description, is the annular area the one operating to make evident the difference of levels in that main plate after tampering the system.

The basic design is the same, but the difference is that the annular area will not lean over the main plate of the internal part before the cap is interlocked. During the closing operation performed by a hit over the roof of the external part, the annular area 60 pivots on the point 50 to allow the central circle 40 reach the interlocking ~one. After that operation, the central circle 40 will be interlocked. The annular area 60 will be positioned over the internal part, but a tension will be present as a result of the forced pivot that the annular area 60 made over the point 50 to allow the center of the circular area 40 to reach the interlocked status. After the bars or connectors of the breach line 70 are broken in the opening operation, nothing will be downwardly holding the annular area 60, so it will recover its original horizontal plane, evidencing the difference of levels with the central circle 40 that remains snugly interlocked to the roof of the internal part.

The critical aspect here is that the annular area is the one that recovers its original status by upwardly flexing after detaching the breach line 70. This upwardly flexing capability is due to the "pivot" action on the Point 50 which is elevated. This makes the difference of levels evident between both areas of the external part.

These alternatives to the tamper evidence can be applied separately or joined to mutually enhance the difference of levels between areas after the system was tampered.

The description set out above is not to be considered limiting. Protection for the invention as defined by the following claims, and all equivalents, is sought.

We claim:

1. A cap for a container comprising:

an internal part and an external part relatively movable with respect to one another between closed, intermediate and open cap positions;

complementary structures protruding from said internal and external parts for dictating relative positions of the internal and external parts as the parts are initially joined together;

interengaging elements on the internal and external parts for securing a selected portion of one of said internal and external parts to the other of said internal and external parts after joining the parts together; and a breakable seal between said selected portion of said one of the internal and external parts and the remainder of said one of the internal and external parts which, when broken, allows the internal and external parts to move relative to one another;

wherein the interengaging elements are interlocking hooks and flanges, defined on the internal and external parts, distributed around said complementary structures.

2. A cap as defined in claim 1, wherein the complementary structures define sectors protruding from said internal and external parts.

3. A cap as defined in claim 2, wherein any of two, three, and four of the sectors are distributed on each of the parts.

4. A cap as defined in claim 1, and further comprising at least one rib on one of the parts cooperating with at least one channel in the other of the parts for guiding relative twisting movement of the, internal and external parts between the closed and open cap positions.

5. A cap as defined in claim 1, wherein said breakable seal is defined by a circular breach line partially cut into an underside of said eternal part.

6. A cap for a container comprising:

an internal part and an external part relatively movable with respect to one another between closed intermediate and open cap positions;

complementary structures protruding from said internal and external parts for dictating relative positions of the internal and external parts as the parts are initially joined together;

interengaging elements on the internal and external parts for securing a selected portion of one of said internal and external parts to the other of said internal and external parts after joining the parts together;

a breakable seal between said selected portion of said one of the internal and external parts and the remainder of said one of the internal and external parts which, when broken, allows the internal and external parts to move relative to one another;

said breakable seal being defined by a circular breach line partially cut into an underside of said eternal part; and a plurality of segments distributed around the breach line for preventing aleatory destruction of said breakable seal.

7. A cap as defined in claim 6, and further comprising a plurality of depending flanges defining a skirt for interacting with an opening of the container.

8. A cap as defined in claim 7, wherein a distal end of each of said depending flanges is provided with a gripping cleat.

9. A cap for a container comprising:

an internal part and an external part relatively movable with respect to one another between closed, intermediate and open cap positions;

a set of elements defined on the internal and external parts cooperating to lock a selected portion of the external part to the internal part when the cap is initially assembled;

a breakable seal between said selected portion of said external part and the remainder of said external part which, when broken, allows the internal and external parts to move relative to one another; and a protrusion formed on said internal part, aligned with said breakable seal, and defining a space into which a perimetrical area of said selected portion flexes downwardly when relative movement of the internal and external parts breaks said seal.

10. A combination of a container and a cap for the container comprising:

an internal part and an external part relatively movable with respect to one another between closed, intermediate and open cap positions;

complementary structures protruding from said internal and external parts for dictating relative positions of the internal and external parts as the parts are initially joined together;

interengaging elements on the internal and external parts for securing a selected portion of one of said internal and external parts to the other of said internal and external parts after joining the parts together; and a breakable seal between said selected portion of said one of the internal and external parts and the remainder of said one of the internal and external parts which, when broken, allows the internal and external parts to move relative to one another;

wherein the interengaging elements are interlocking hooks and flanges, defined on the internal and external parts, distributed around said complementary structures.

11. A combination of a container and a cap for the container as defined in claim 10, wherein the complementary structures define sectors protruding from said internal and external parts.

12. A combination of a container and a cap for the container as defined in claim 11, wherein any of two, three and four of the sectors are distributed on each of the parts.

13. A combination of a container and a cap for the container as defined in claim 10, and further comprising at least one rib on one of the parts cooperating with at least one channel in the other of the parts for guiding relative twisting movement of the internal and external parts between the closed and open cap positions.

14. A combination of a container and a cap for the container as defined in claim 10, wherein said breakable seal is defined by a circular breach line partially cut into an underside of said eternal part.

15. A combination of a container and a cap for the container comprising:

an internal part and an external part relatively movable with respect to one another between closed, intermediate and open cap positions;

complementary structures protruding from said internal and external parts for dictating relative positions of the internal and external parts as the parts are initially joined together;

interengaging elements on the internal and external parts for securing a selected portion of one of said internal and external parts to the other of said internal and external parts after joining the parts together;

a breakable seal between said selected portion of said one of the internal and external parts and the remainder of said one of the internal and external parts which, when broken, allows the internal and external parts to move relative to one another; and a plurality of segments distributed around the breach line for preventing aleatory destruction of said breakable seal.

16. A combination of a container and a cap for the container as defined in claim 15, and further comprising a plurality of depending flanges defining a skirt for interacting with an opening of the container.

17. A combination of a container and a cap for the container as defined in claim 16, wherein a distal end of each of said depending flanges is provided with a gripping cleat.

* * * * *